US006311027B1

(12) United States Patent
Sakita et al.

(10) Patent No.: US 6,311,027 B1
(45) Date of Patent: Oct. 30, 2001

(54) IMAGE-FORMING APPARATUS WHICH FORMS IMAGES BY USING A DEVELOPER

(75) Inventors: Hirofumi Sakita, Tenri; Syouichi Fujita, Kashiba; Hideji Saiko, Kitakatsuragi-gun; Mitsuru Tokuyama, Soraku-gun; Masatsugu Nakamura, Kashiba; Hiroo Naoi, Nara; Kouichi Takenouchi, Nabari, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/477,628

(22) Filed: Jan. 4, 2000

(30) Foreign Application Priority Data

Jan. 14, 1999 (JP) ..... 11-008418
Jan. 20, 1999 (JP) ..... 11-012251

(51) Int. Cl.[7] ..... G03G 15/02; H01T 23/00
(52) U.S. Cl. ..... 399/50; 361/235; 399/171
(58) Field of Search ..... 399/50, 170, 171; 361/230, 235

(56) References Cited

U.S. PATENT DOCUMENTS 4,335,420 * 6/1982 Mitsuo et al. ..... 399/171 X
4,638,397 * 1/1987 Foley ..... 361/235 X
4,811,045 * 3/1989 Matsushita et al. ..... 399/171
4,868,907 * 9/1989 Folkins ..... 361/235 X
5,173,734 * 12/1992 Shimizu et al. ..... 399/50
5,181,070 * 1/1993 Masuda ..... 399/171
5,581,221 * 12/1996 Kawai et al. ..... 399/50 X
5,659,839 * 8/1997 Mizude et al. ..... 399/50
5,805,956 * 9/1998 Kawai et al. ..... 399/50 X

FOREIGN PATENT DOCUMENTS

A6282126 10/1994 (JP) .

* cited by examiner

*Primary Examiner*—Fred L Braun

(57) ABSTRACT

An image-forming apparatus is provided with: a rotatable photoreceptor; a charging device for charging the surface of the photoreceptor to a predetermined electric potential. A device for corona discharging, the charging device has a control electrode for controlling the quantity of corona ions that are allowed to reach the photoreceptor. A latent image forming device for forming an electrostatic latent image on the photoreceptor that has been charged by the charging device by use of light irradiation. There is a developing device for developing the electrostatic latent image by using a developer; and a control voltage supply device for supplying a control voltage to the control electrode and for switching the control voltage to a plurality of stages from a low-voltage side to a high-voltage side until the surface electric potential of the photoreceptor has risen to a predetermined electric potential. This image-forming apparatus prevents carrier rise at the time of a rise of the photoreceptor surface electric potential.

27 Claims, 31 Drawing Sheets

IMAGE-FORMING APPARATUS WHICH FORMS IMAGES BY USING A DEVELOPER

FIELD OF THE INVENTION

The present invention relates to image-forming apparatuses such as, for example, optical printers such as laser printers and LED printers, electrophotographic copying machines and facsimile machines, which form images on a copying material by using developer.

BACKGROUND OF THE INVENTION

A conventional image-forming apparatus, such as a laser printer and an electro copying machine, has a construction, for example, as shown in FIG. 29. In this image-forming apparatus, the formation of an electrostatic latent image is carried out on a photoreceptor drum 101 by uniformly charging the surface of a photoreceptor drum 101 by a charger 102 and then partially reducing the electric potential of the surface by exposure carried out by an exposure device 103. In this case, an aluminum element cylinder (not shown in the Figure) forming a base body of the photoreceptor drum 101 is connected to ground through the drum flange and the drum shaft; thus, it is possible to partially reduce the electric potential at the exposed portions on the photoreceptor drum 101.

Moreover, the above-mentioned electrostatic latent image is developed by applying a developing bias to a developing device 104 so as to allow developer to adhere to the electrostatic latent image in the developing device 104.

Normally, a scorotron charger is used as the above-mentioned charger 102. As illustrated in the same Figure, this charger is provided with a control grid 102*b* which can control the quantity of corona ions that reaches the surface of the photo receptor drum 101 from the discharge wire 102*a*.

The image-forming apparatus is further provided with a transfer device 105, a separation device 106, cleaning device 107 and a static eliminating lamp 108.

In the conventional image-forming apparatus, when no electric potential is applied thereto by the charger 102, the surface electric potential of the photoreceptor drum 101 is maintained at 0 V. For this reason, in an image-forming apparatus using a reversal developing system, during non-image-forming periods such as the initial setting time, a warming up period, a printing start time or a printing end time, if the developing device 104 or the photoreceptor drum 101 is rotated, developer tends to adhere to the photoreceptor drum 101, thereby causing the developer to be unnecessarily consumed. In order to prevent such a problem, electric potentials are applied to both of the photoreceptor drum 101 and the developing device 104 even during the above-mentioned non-image-forming periods.

For example, Japanese Laid-Open Patent Application No. 282126/1994 (Tokukaihei 6-282126), published on Oct. 7, 1994) has proposed a construction in which, during an unstable rotation period at the time of starting the main motor, an electric potential having the same polarity as the developer is applied to an area of the photoreceptor on which the developing device acts. For example, in the apparatus shown in FIG. 29, a high-voltage transformer power supply 109 is connected as the power source for the control grid 102*b*. In this construction, during the non-image-forming period, the respective sections are operated in synchronized timing as shown in FIG. 30. Here, the drum motor is a driving motor for the photoreceptor drum 101, and the laser light emission is a releasing operation of a laser beam from the laser device installed in the exposure device 103.

Here, in the high-voltage transformer power source 109, at the time of a rise in voltage, an unstable area appears, which is an area in which the voltage becomes uncontrollable at the leading-edge on the low voltage side. As shown in FIG. 31, because of this unstable area, the surface electric potential of the photoreceptor is not allowed to rise linearly, and has a distortion including so-called rounding 111. For this reason, during the rising process of the surface electric potential of the photoreceptor to a predetermined electric potential, the electric potential difference (fog electric potential) between the surface electric potential of the photoreceptor and the developing bias becomes excessively greater. As a result, scattering of the carrier (carrier rise) from the developing device 104 occurs, resulting in problems such as short service life of the photoreceptor in the photoreceptor drum 101, formation of toner aggregation with scattered carrier serving as cores at the time of recycling the toner, and the subsequent degradation in copied images.

SUMMARY OF THE INVENTION

The present invention has been devised so as to solve the above-mentioned problems, and its objective is to provide an image-forming apparatus which can prevent degradation in images due to the short service life of the photoreceptor caused by toner scattering and the formation of toner aggregation with scatted carrier serving as cores at the time of recycling the toner, during non-image-forming periods such as the initial setting time, a warming up period, a printing start time or a printing end time.

In order to achieve the above-mentioned objective, the image-forming apparatus of the present invention is provided with: a rotatable photoreceptor; a charging device for charging the surface of the photoreceptor to a predetermined electric potential by means of corona discharging, the charging device being provided with a control electrode for controlling the quantity of corona ions that are allowed to reach the photoreceptor from a discharging electrode; a latent image forming device for forming an electrostatic latent image on the photoreceptor that has been charged by the charging device by means of light irradiation; a developing device for developing the electrostatic latent image by using a developer; and a control voltage supply device for supplying a control voltage to the control electrode and for switching the control voltage to a plurality of stages from a low-voltage side to a high-voltage side until the surface electric potential of the photoreceptor has risen to a predetermined electric potential.

With the above-mentioned arrangement, the rotating photoreceptor is charged to a predetermined electric potential by the charging device, an electrostatic latent image is formed on the surface of the photoreceptor by the latent image forming device, and this electrostatic latent image is developed by the developing device.

When the photoreceptor is charged to the predetermined electric potential by the charging device, the control voltage, supplied from the control voltage supply device to the control electrode of the charging device, is switched to a plurality of stages from the low-voltage side to the high-voltage side until the surface electric potential of the photoreceptor has risen to the predetermined electric potential.

Thus, it is possible to prevent the generation of the unstable portion of the electric potential at the time of a rise of the surface electric potential of the photoreceptor, and consequently to allow the surface electric potential of the photoreceptor to rise linearly to the predetermined electric potential. As a result, it is possible to prevent degradation in the photoreceptor due to scattering of carrier, degradation in the image quality due to aggregation of toner with scattering carrier serving cores at the time of recycling toner, and adhesion of reversely charged toner to the photoreceptor and an increase of the consumption of toner; consequently, it becomes possible to obtain image having stable image quality.

For a fuller understanding of the nature and advantages of the invention, reference should be made to the ensuing detailed description taken in conjunction with the accompanying drawings.

DESCRIPTION OF THE EMBODIMENTS

Embodiment

Referring to FIGS. 1 through 8, the following description will discuss one embodiment of the present invention.

Figure 1:
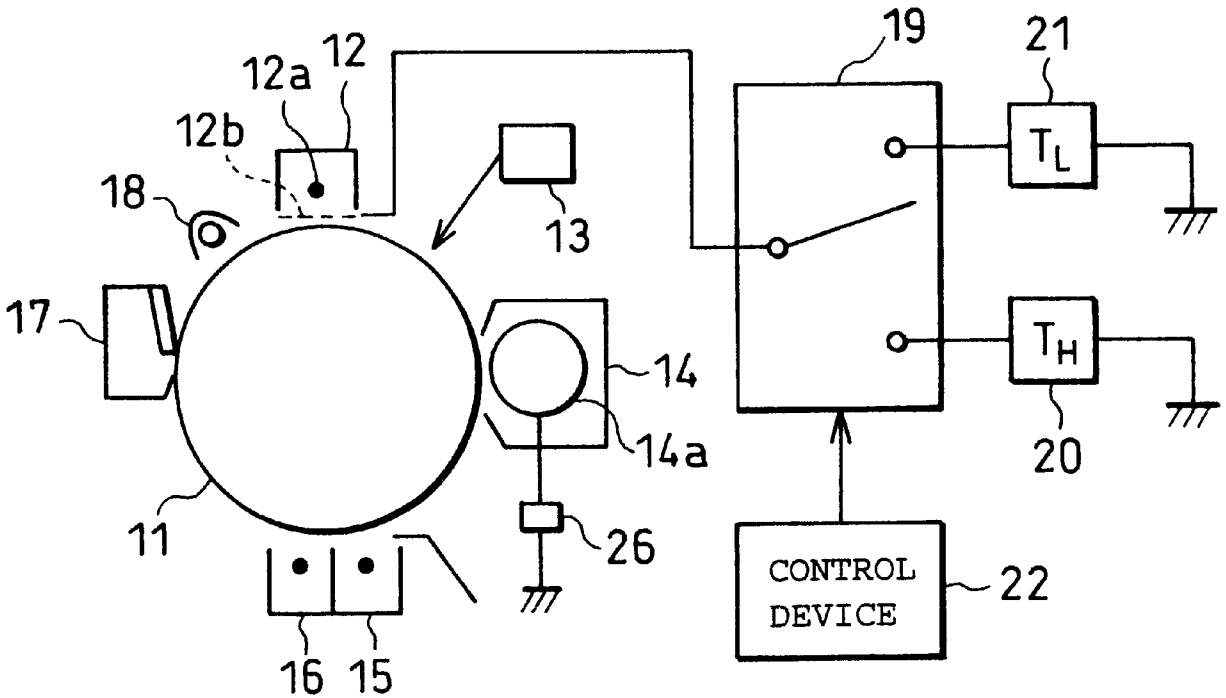
FIG. 1 is a schematic side view that shows the entire structure of an image-forming apparatus in accordance with one embodiment of the present invention.

As illustrated in FIG. 1, the image-forming apparatus of the present embodiment is provided with a photoreceptor drum 11, and on the periphery of this photoreceptor drum 11 are placed a charger (electro static charge means) 12, an exposure device 13, a developing device (developing means) 14, a transfer device 15, separation device 16, cleaning device 17 and static-eliminating lamp 18 in this order in the rotation direction of the photoreceptor drum 11.

The developing device 14 houses grainy carrier and powder toner inside thereof, and the toner is transported while being attracted by the carrier, and the toner is supplied onto the surface of the photoreceptor drum 11 by the developing roller 14*a*. The above-mentioned carrier is a magnetic carrier, and the toner is a non-magnetic toner, and developing device 14 uses the two-component reversal developing system.

In this image-forming apparatus, the image-formation operation is carried out as follows:

First, the photoreceptor drum 11 is driven and rotated by a drum motor, and the surface of the photoreceptor drum 11 is charged to a uniform electric potential by the charger 12. Next, the surface of the photoreceptor drum 11 is irradiated with a laser light beam from the exposure device 13 so that an electrostatic latent image is form thereon. As described earlier, the formation of an electrostatic latent image on the photoreceptor drum 11 is carried out as follows: The aluminum element cylinder (not shown in the Figure), which forms a base body of the photoreceptor drum 11, is connected to ground through the drum flange and the drum shaft so that the irradiation by the laser beam causes the irradiated portion to have a drop in the electric potential.

The above-mentioned electrostatic latent image is developed by the toner supplied from the developing device 14 to form a toner image. At this time, a developing bias from a developing bias power supply (developing bias supply means) 26 is applied to the developing roller 14*a* of the developing device 14 so as to supply the toner to the surface of the photoreceptor drum 11.

Thereafter, the tone image is transferred by the transfer device 15 onto paper (not shown) as a copying material that has been transported between the transfer device 15 and the photoreceptor drum 11. Then, the paper, attracted to the surface of the photoreceptor drum 11, is separated from the surface by the separation device 16.

Moreover, toner remaining on the surface of the photoreceptor drum 11 is collected by the cleaning device 17, and electric charge remaining on the surface of the photoreceptor drum 11 is eliminated by the static-eliminating lamp 18.

The charger 12 is constituted by a Scorotron charger, and provided with a control grid (control electrode) 12*b* which can control the quantity of corona ions that are released from discharging wires (discharging electrodes) 12*a* and reach the surface of the photoreceptor drum 11.

A high-voltage power supply (not shown) for outputting a high voltage of several kV is connected to the discharging wires 12*a*. Moreover, to the control grid 12*b* are connected, through a switch (control voltage supply means) 19, a high-voltage power supply (control voltage supply means) 20 having a high-voltage transformer (TH) and a low-voltage power supply (control supply means) 21 that has a low-voltage transformer (TL) and serves as a constant low voltage power supply. In the present embodiment, the output voltage of the voltage power supply 21 is approximately 100 V, and the output voltage of the high-voltage power supply 20 is approximately 1000 V. Here, both of the voltages have a minus polarity.

The switching operation of the switch 19 is controlled by a controller 22 having, for example, a microcomputer.

Figure 2:
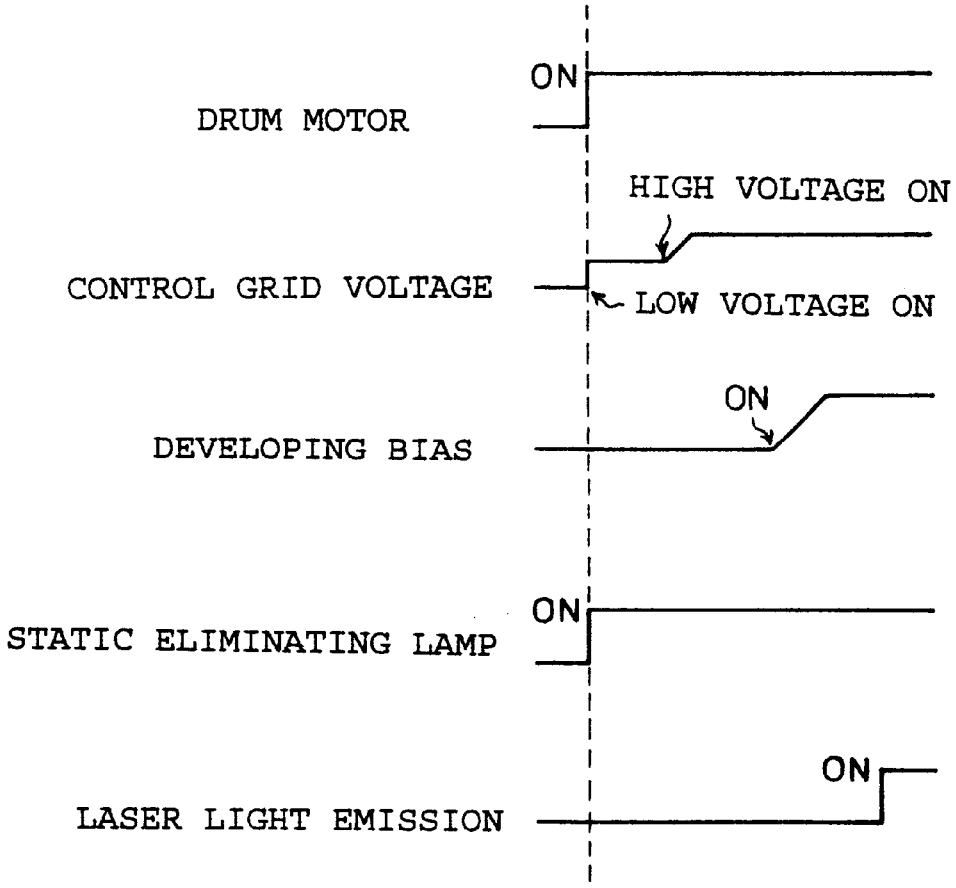
FIG. 2 is a timing chart that shows operation timings of respective parts of the image-forming apparatus shown in FIG. 1.

In the present image-forming apparatus having the above-mentioned construction, a sequence of the image-forming operation is carried out as described above. In this case, in a non-image-forming period from the rotation start of the drive motor of the photoreceptor drum 11, that is, a drum motor, to the light-emitting operation in the laser device provided in the exposure device 13, the respective parts operate in a manner as shown in FIG. 2.

In other words, simultaneously as the drum motor is started to rotate, the static-eliminating lamp 18 and the charger 12 are turned on. At this time, in the charger 12, a high voltage is applied to the discharging wire 12*a* and the switch 19 is switched to the low voltage power supply 21 side; thus, a predetermined low voltage is supplied to the control grid 12*b* from the low voltage power supply 21.

Next, the switch 19 is switched to the high voltage power supply 20 side so that a predetermined high voltage is supplied to the control grid 12*b*, and this high voltage is maintained from this time on. Thereafter, a developing bias is applied to the developing roller 14*a* of the developing device 14, and the laser light emission is then started.

The timing in which the switching is made from the low voltage power supply 21 side to the high voltage power supply 20 side by the above-mentioned switch 19 is set at the point of time, for example, immediately after the surface electric potential of the photoreceptor drum 11 rises after the voltage application from the low voltage power supply 21 to the control grid 12*b*. Therefore, in the case when a plurality of switching voltages are set from the low voltage side to the high voltage side, immediately after the surface electric potential of the photoreceptor drum 11 is allowed to rise by the switched voltage, the switching is made to the next high voltage side.

As described above, the surface electric potential of the photoreceptor drum 11 is allowed to rise by supplying an electric potential from the charger 12, and finally reaches a predetermined electric potential. In this case, the low voltage bias from the low voltage power source 21 is first applied, and the high voltage from the high voltage power supply 20 is then applied to the control grid 12*b* of the charger 12; this makes the rise of the photoreceptor surface electric potential smoother in a linear fashion, as shown in FIG. 3.

Figure 3:
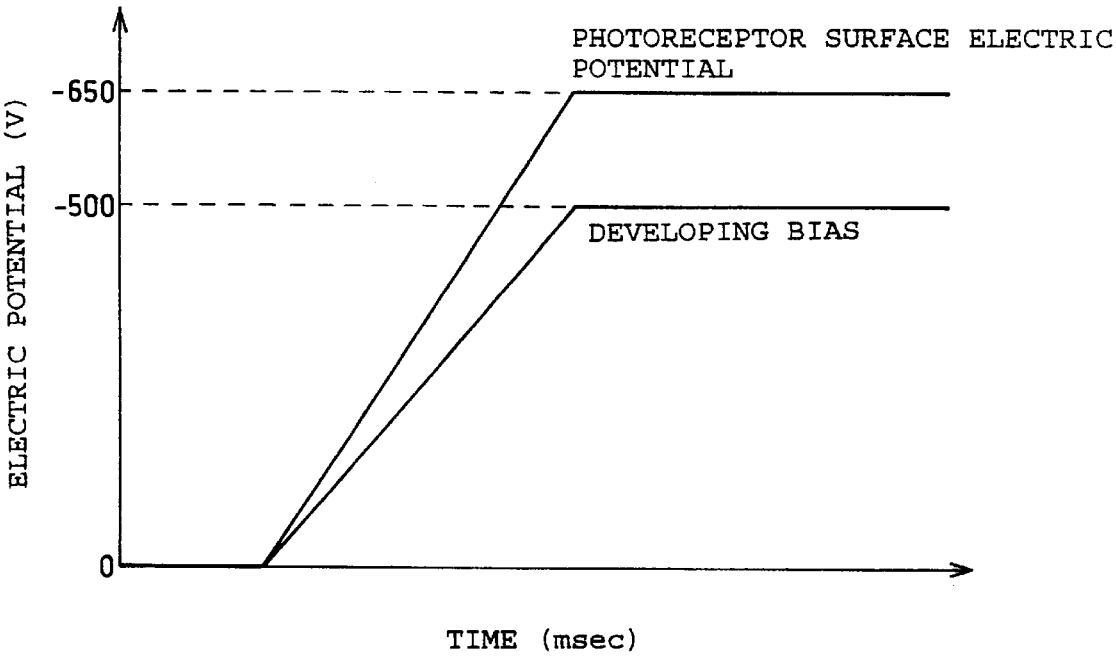
FIG. 3 is a graph that shows the relationship between the surface electric potential of a photoreceptor and the developing bias at the time of its rise in the image-forming apparatus shown in FIG. 1.

Therefore, as shown in FIG. 3, the electric potential difference between the photoreceptor surface electric potential and the developing bias, that is, so-called fog electric potential ((developing bias electric potential)—(photoreceptor surface electric potential)) is allowed to stability change, without becoming excessively large. In other words, the fog electric potential does not increase beyond a stable electric potential (that is, the electric potential difference between the photoreceptor surface electric potential −650V and the developing bias −500V); thus, it becomes possible to prevent the fog electric potential from exceeding a predetermined value. As a result, it is possible to prevent "carrier rise", that is, adhesion of the carrier to the surface of the photoreceptor surface due to dispersion of the carrier from the developing device 14 and "PC fog", that is, adhesion of the toner to the photoreceptor surface due to dispersion of the toner from the developing device 14.

Figure 31:
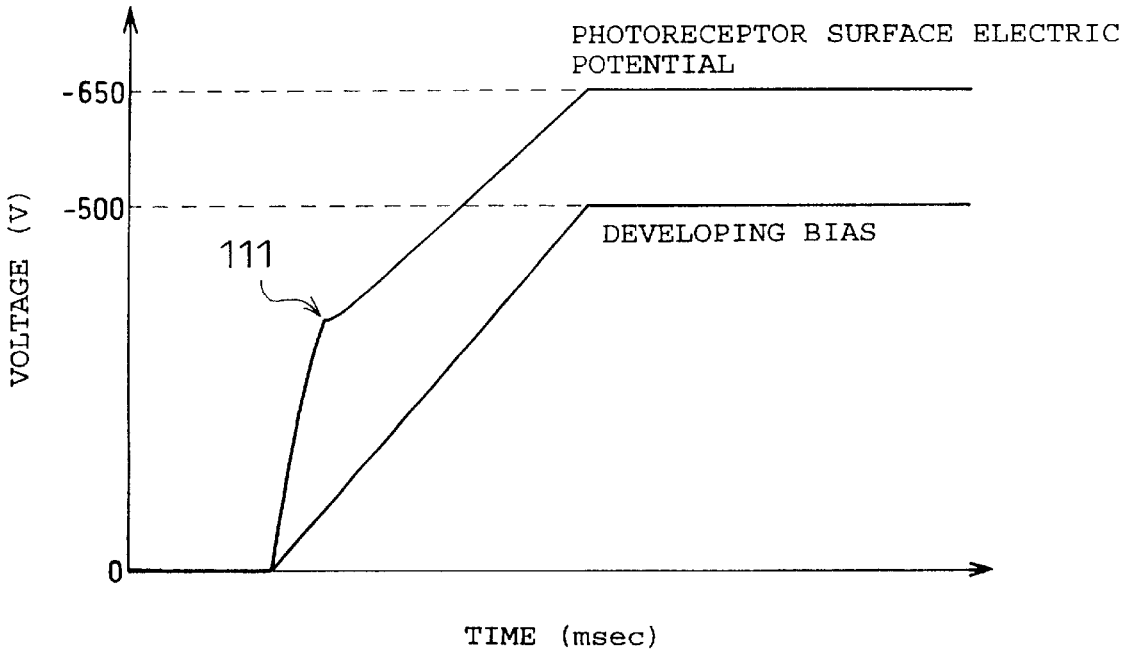
FIG. 31 PRIOR ART
FIG. 31 is a graph that shows the relationship between the surface electric potential of the photoreceptor and the developing bias at the time of rising in the image-forming apparatus shown in FIG. 29.

In contrast, in a conventional image-forming apparatus, as illustrated in FIG. 31, the fog electric potential becomes extremely large due to rounding 111. In this case, the fog electric potential is approximately 500V at the generation position of the rounding 111, and the maximum value of the fog electric potential in the conventional apparatus is considered to be approximately 500 to 600 V.

Figure 4:
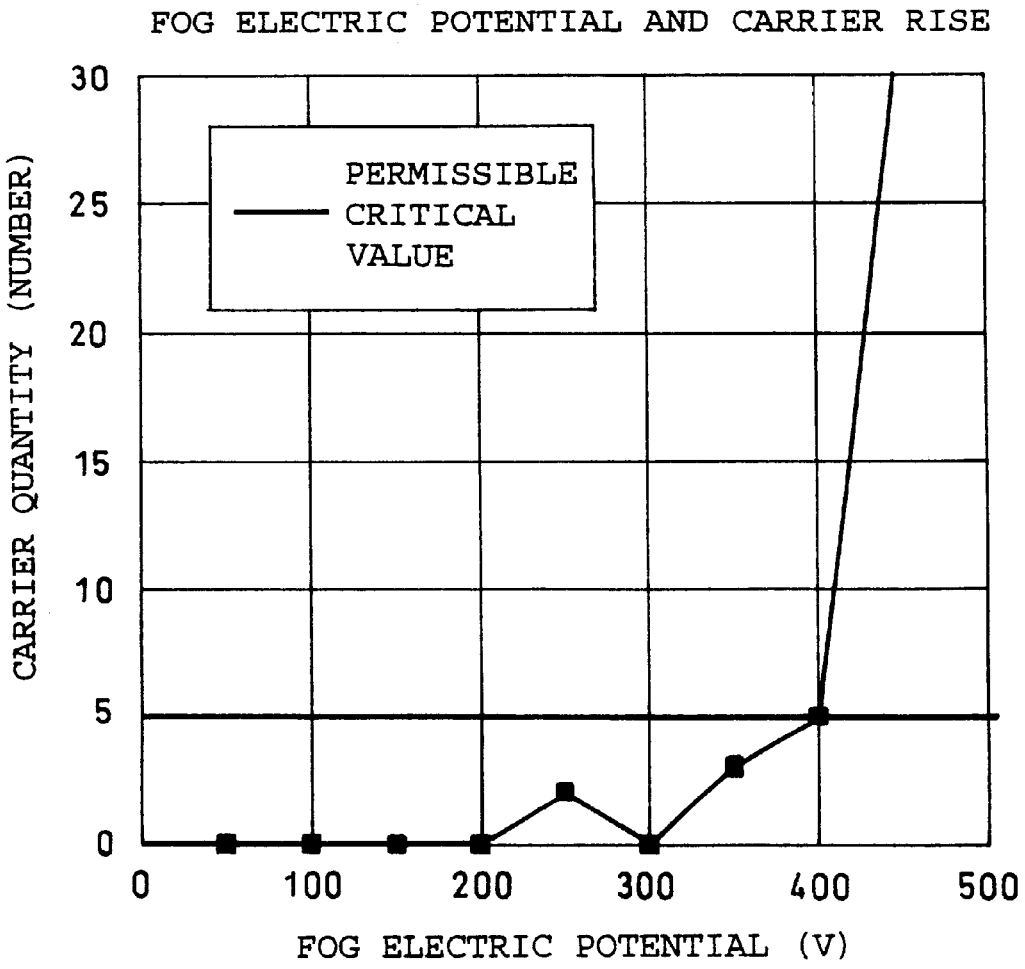
FIG. 4 is a graph that shows the relationship between the fog electric potential and the carrier rise in the image-forming apparatus.

Here, FIG. 4 shows the relationship between the fog electric potential and the carrier rise (adhesion of carrier to the photoreceptor drum due to carrier dispersion from the developing device 14). As clearly shown by FIG. 4, as the fog electric potential becomes greater, the carrier rise from the developing device 14 increases. In the case of the fog electric potential of not more than 400V, the number (Car number) of carrier rise drops abruptly, reaching a level that causes no problems in copied image quality.

Although no carrier rise is inherently desirable for maintaining good copying quality, the carrier rise in the range of approximately 5 to 6 hardly becomes conspicuous, and this range is considered to be a permissible range without causing any adverse effects on the copied images, from the experimental and experience point of view.

Therefore, in the conventional apparatus, the number of carrier rise exceeds the permissible range in number, resulting in deterioration in the photoreceptor drum 11 due to carrier dispersion as well as degradation in the image quality due to aggregation formed around the carrier as cores at the time of toner recycling.

Figure 5:
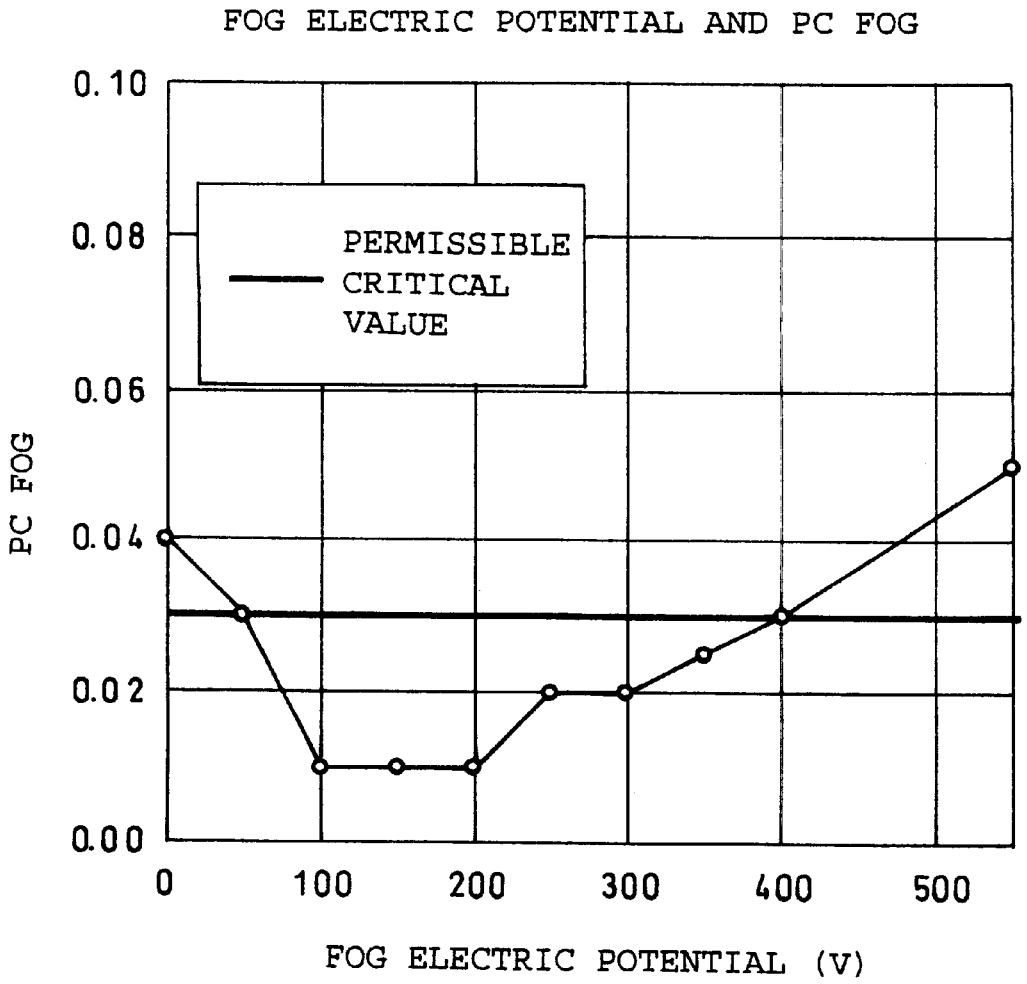
FIG. 5 is a graph that shows the relationship between the fog electric potential and the PC fog in the image-forming apparatus.

Moreover, FIG. 5 shows the relationship between the fog electric potential and the so-called PC fog (adhesion of weakly charged or zero-charged toner to the photoreceptor surface). FIG. 5 clearly shows that the PC fog increases when the fog electric potential becomes extremely small or extremely large, and it is comparatively small in the range of 50 to 400V, and is stable in the range of 100 to 200V.

In particular, when the fog electric potential is set in the range of 100 to 200V, it is possible to stably reduce the adhesion of reversely charged, weakly charged, or zero-charged toner to the photoreceptor drum 11, and also to eliminate problems caused by carrier dispersion. As a result, it becomes possible to prevent toner dispersion, degradation in the toner consumption, and deterioration of the photoreceptor drum, and consequently to maintain superior image quality for a long time.

Although the PC fog is not reduced to zero as long as copying processes are carried out repeatedly with toner being allowed to adhere the photoreceptor surface, it is permissible if the amount thereof is set sufficiently small so as not to adversely affect the copied image. In the PC fog (ΔID) shown in FIG. 5, the value, 0.03, is considered to be a permissible critical value in terms of the copy image quality from the long term point of view.

Therefore, the fog electric potential that makes the PC fog out of the permissible range is less than 50V as well as more than 400V; and as shown in FIG. 31, in the conventional image-forming apparatus that has an extremely great fog electric potential due to rounding 111, the PC fog is located out of the permissible range. This results in degradation in the copied image quality due to toner dispersion and an increase in the toner consumption. In contrast, as described above, in the present image-forming apparatus, since the photoreceptor surface electric potential is allowed to smoothly rise, and since the fog electric potential is stably changed, it is possible to prevent the above-mentioned problem.

Moreover, from FIG. 4 and FIG. 5, the range of the fog potential that can reduce both the carrier rise and the PC fog to permissible ranges is from 50 to 400V, and the present image-forming apparatus makes it possible to maintain the fog electric potential in this range as described above.

Here, it is found from the above-mentioned description that in the non-image-formation period among periods in which the photoreceptor drum 11 is driven, the photoreceptor surface electric potential should be maintained on the minus side as compared with the developing bias electric potential.

In FIG. 5, the residual toner densities after the copying process at the respective fog electric potentials as compared with the toner density in the initial state of the photoreceptor surface are indicated as the PC fog. The axis of ordinate indicates the variation of the image density (ID) measured with a Macbeth densitometer. That is, this indicates the difference between the image density in the initial state of the photoreceptor surface and the image density (residual toner density) in the toner remaining state after the copying operation. The residual toner density is obtained from the toner density in the initial state of the photoreceptor surface and the toner density on the photoreceptor surface in the state corresponding to each fog electric potential. More specifically, an adhesive tape was used to remove residual toner from the photoreceptor surface at each of the states, and this was transferred onto paper, and the ID was measured with the densitometer.

Moreover, in the present image-forming apparatus, the voltage application time of the low voltage power supply 21 to the control grid 12*b* is set within one rotation of the photoreceptor drum 11. This is because it is found that, when the voltage application from the low voltage power supply 21 is continued beyond one rotation, the service life of the photoreceptor drum 11 is shortened. In other words, the above-mentioned arrangement shortens the excessive rotation time of the photoreceptor drum 11, prevents degradation in charging of the photoreceptor drum 11 due to film reduction in the photosensitive film, and consequently to provide stable images for a long time.

Figure 6:
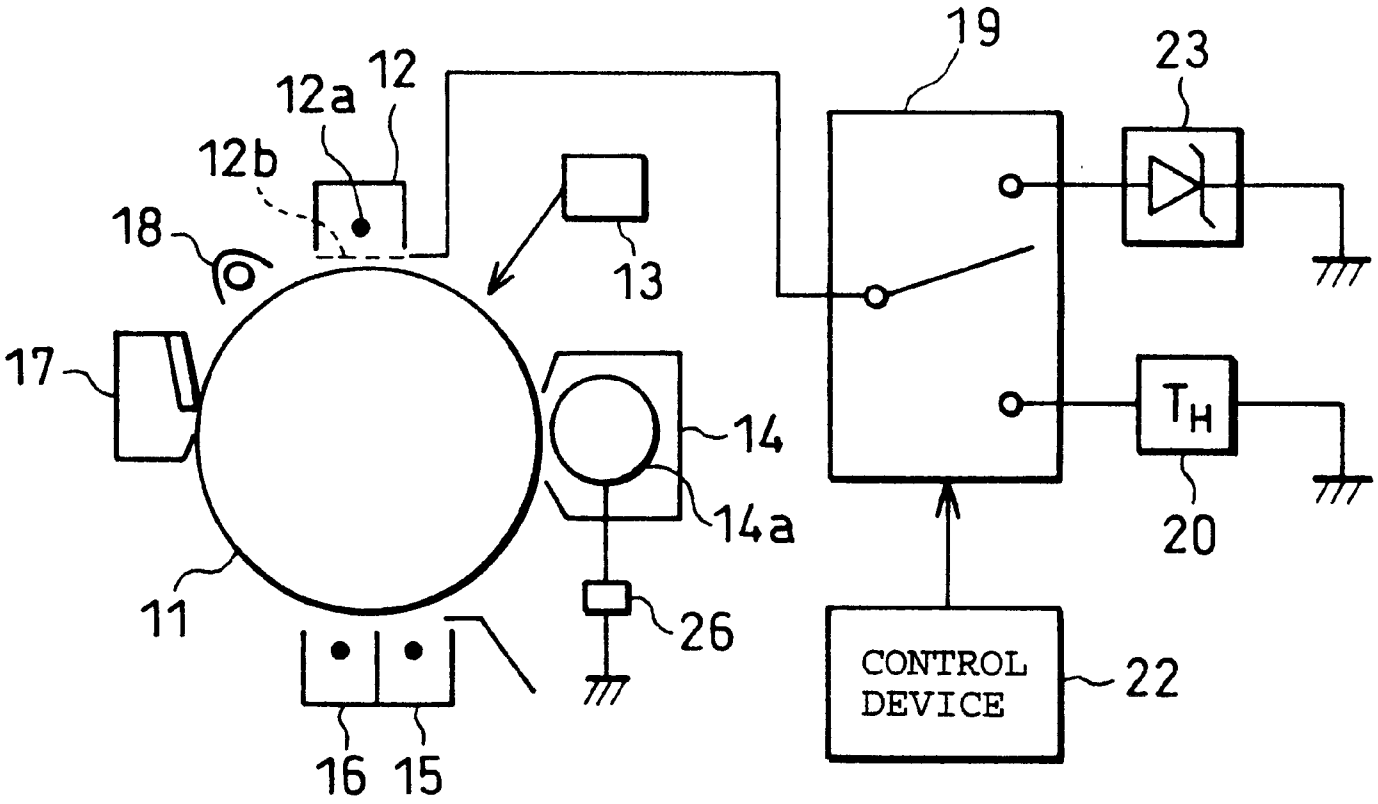
FIG. 6 is a schematic side view that shows the entire structure of an image-forming apparatus in which a power supply consisting of a Zener diode is adopted as a low-voltage power supply for a control grid power supply in the image-forming apparatus shown in FIG. 1.

Moreover, the image-forming apparatus, shown in FIG. 1, may be modified to have an arrangement shown in FIG. 6. In this arrangement, instead of the low voltage power supply 21 using a low voltage transformer ($T_L$), a low voltage power supply 23 using a Zener diode is provided. In this arrangement, since the Zener diode is used instead of the low voltage transformer ($T_L$), it is possible to simplify and miniaturize the construction.

Figure 7:
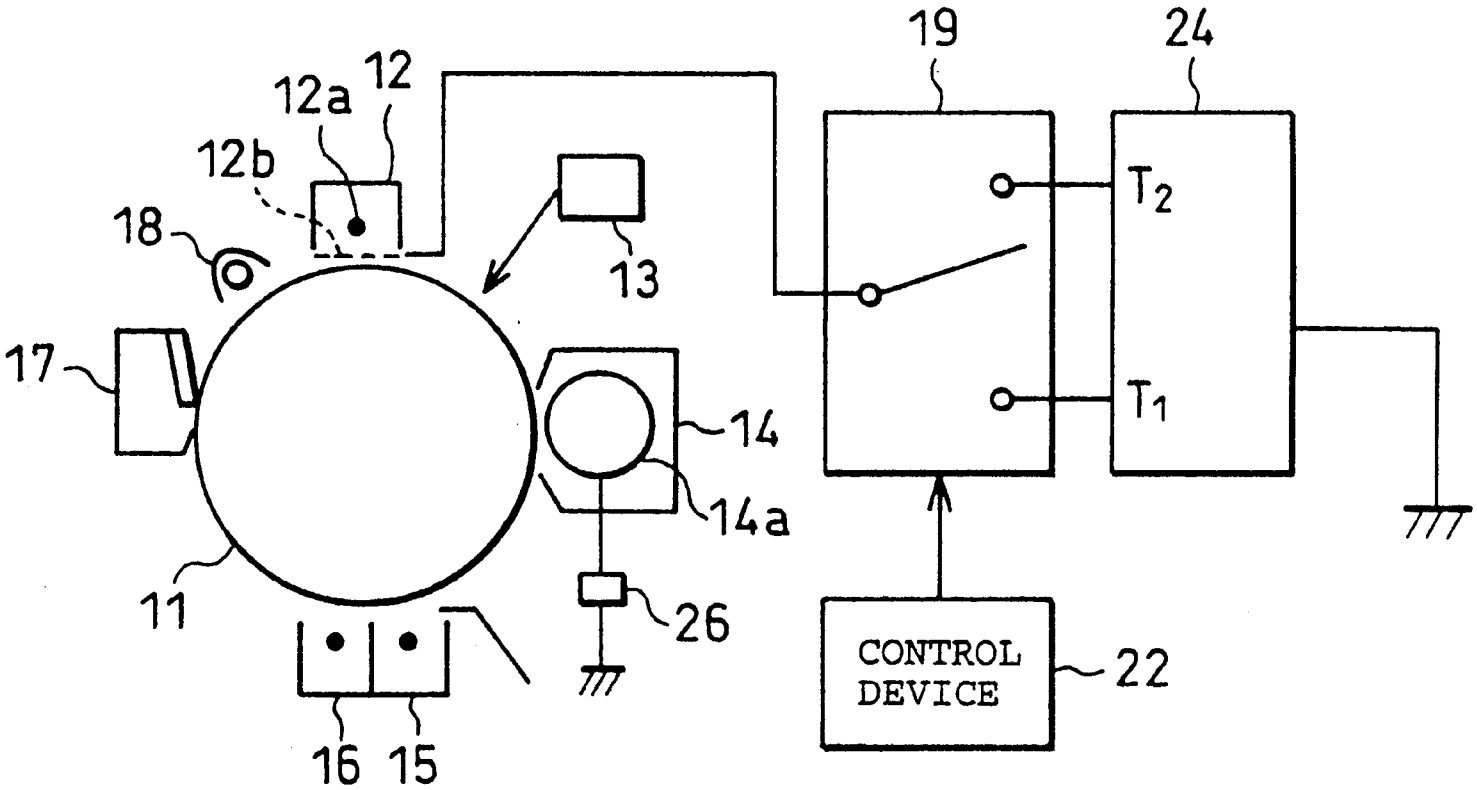
FIG. 7 is a schematic side view that shows the entire structure of an image-forming apparatus in which a power supply consisting of one constant voltage transformer is provided as the control grid power supply in the image-forming apparatus shown in FIG. 1.

Moreover, the present image-forming apparatus may have an arrangement as shown in FIG. 7. In this arrangement, instead of the high voltage power supply 20 having a high voltage transformer ($T_H$) and the low voltage power supply 21 having a low voltage transformer ($T_L$), one control grid power supply (control voltage supply means) 24 is installed. This control grid power supply 24 is provided with a constant voltage transformer, a low voltage terminal $T_1$ and a high voltage terminal $T_2$. These low voltage terminal $T_1$ and high voltage terminal $T_2$ are successively switched in the same manner as described earlier. This arrangement makes it possible to miniaturize the entire apparatus and also to reduce mass production costs.

Figure 8:
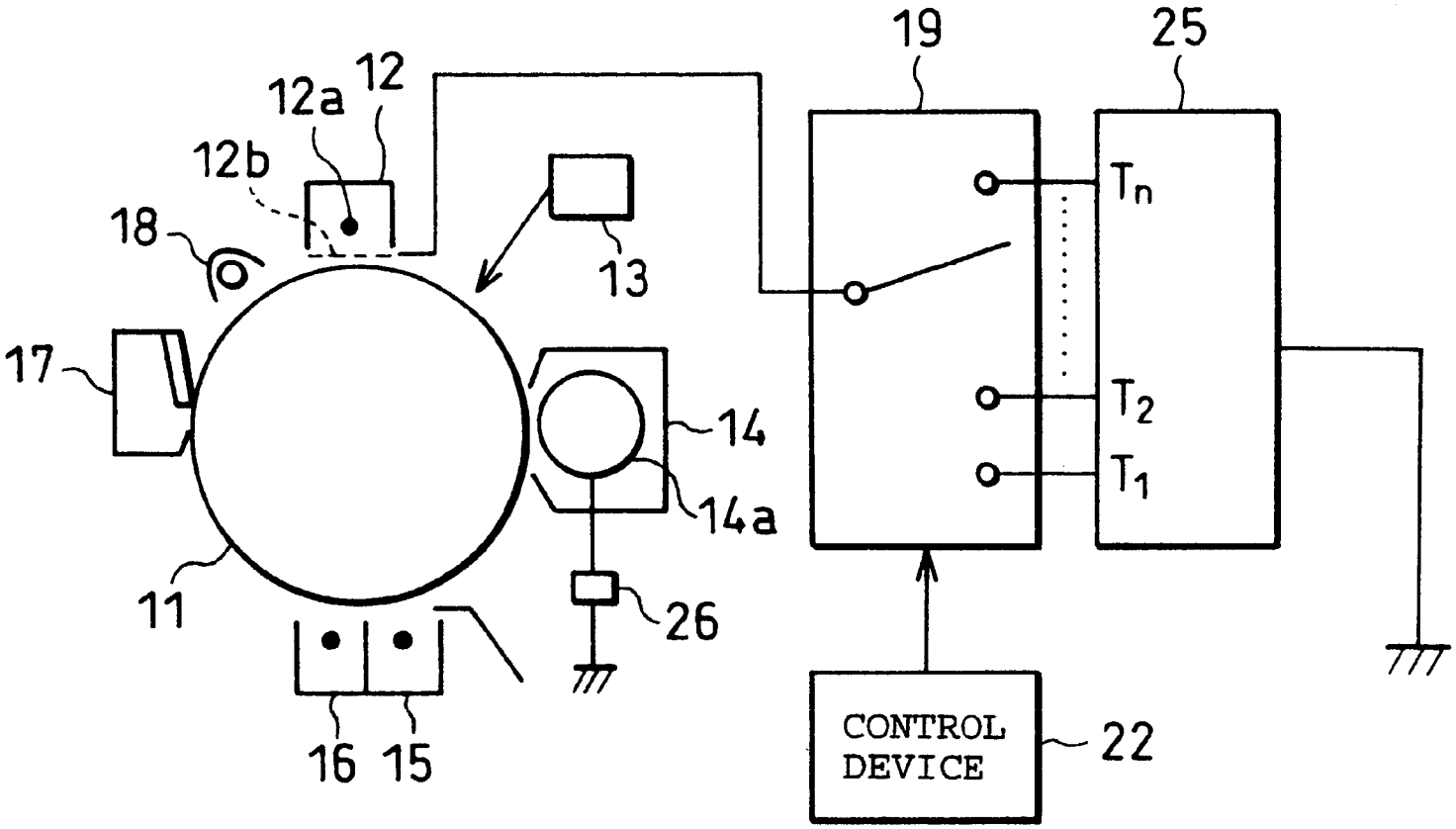
FIG. 8 is a schematic side view that shows the entire structure of an image-forming apparatus in which a power supply consisting of one constant voltage transformer having not less than three output terminals from a low-voltage side to a high-voltage side is provided in the image-forming apparatus shown in FIG. 7.

Furthermore, the present image-forming apparatus may have an arrangement as shown in FIG. 8. In this arrangement, instead of the control grid power supply 24 shown in FIG. 7, a control grid power supply (control voltage supply means) 25 is installed. This control grid power supply 25 is provided with a constant voltage transformer, and not less than three output terminals T1, T2, . . . , Tn are provided from the low voltage side to the high voltage side. These output terminals T1 to Tn are successively switched by the switch 19 from the low voltage side to the high voltage side. The application of such a control grid power supply 25 allows the photoreceptor surface electric potential to rise more stably and smoothly. In other words, it is possible to control the surface electric potential of the photosensitive drum 11 more stably with higher precision. Consequently, it becomes possible to vary the fog electric potential more stably, and also to prevent the PC fog and the carrier rise more positively.

Embodiment 2

Figure 9:
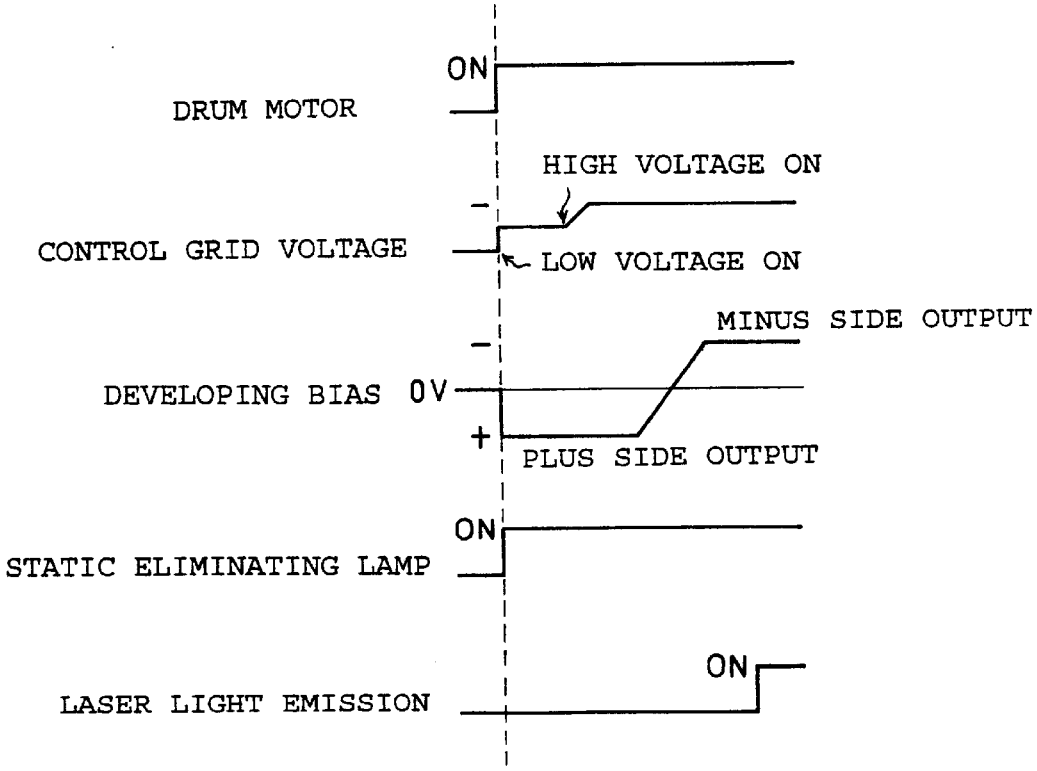
FIG. 9 is a timing chart indicating operation timings of respective parts in an image-forming apparatus of another embodiment in the present invention.
Figure 10:
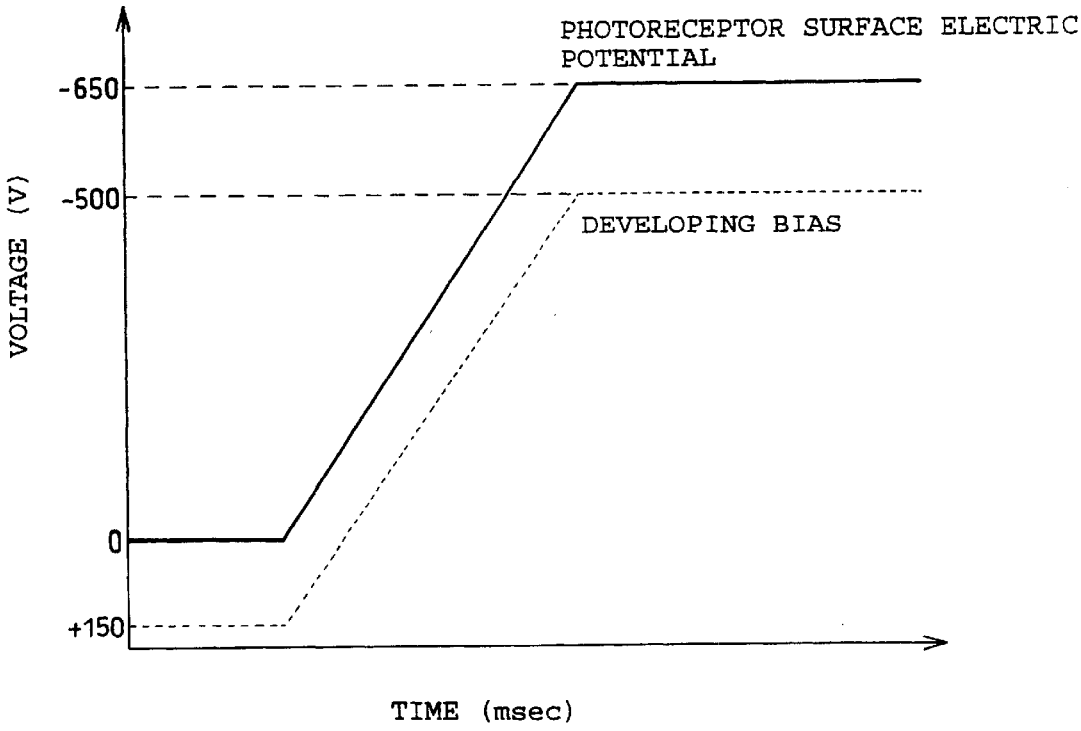
FIG. 10 is a graph that shows the relationship between the surface electric potential of the photoreceptor and the developing bias at the time of rising in the operations shown in FIG. 9.

Referring to FIGS. 1, 9 and 10, the following description will discuss another embodiment of the present invention. Here, for convenience of explanation, those of the means having the same functions as the means shown in the aforementioned drawings are indicated by the same reference numerals and the description thereof is omitted.

In the present image-forming apparatus, for example, in an arrangement shown in FIG. 1, the developing bias power supply 26 is allowed to change its output voltage so that the developing bias to the developing roller 14*a* is controlled as follows:

With respect to the developing bias, as illustrated in FIG. 9, simultaneously as the low voltage power supply 21 applies a low voltage (the minus side output) to the control grid 12*b* of the charger 12, a voltage of the plus side output is applied, and thereafter, a normal developing bias voltage of the minus side output is applied. The above-mentioned plus side output has the reversed polarity to the control voltage to be applied to the control grid 12*b* and the toner charging polarity. The voltage of the plus side output is, for example, 150V, and the period for applying this voltage is set to a period during which a portion having a surface electric potential rise on the photoreceptor drum 11 by the application of the grid voltage to the control grid 12*b* reaches the developing section, that is, the opposing portion of the photoreceptor drum 11 and the developing roller 14*a*. The portion of the photoreceptor drum 11 which is allowed to pass through the developing section during this period has a surface electric potential of 0V.

As described above, by controlling the developing bias, the fog electric potential is stably maintained virtually at a constant value from the initial state of the rise of the photoreceptor surface electric potential, as shown in FIG. 10. With this arrangement, it is possible to positively prevent the PC fog caused by an extremely small fog electric potential (in a range less than 50V in the fog electric potential shown in FIG. 5).

Here, the respective image-forming apparatuses use the reversal developing system. In the reversal developing system, an image exposure representative of image information to be recorded is carried out on the surface of the photoreceptor drum 11 uniformly charged, by using a laser beam, an LED, etc., so that an electrostatic latent image is formed thereon, and toner charged with the same polarity as the charged polarity of the photoreceptor drum 11 is allowed to adhere to the portion having an electric potential drop due to the exposure at this time, with the result that a toner image is formed. Therefore, the respective image-forming apparatuses are applicable to digital copying machines, printers, etc. using the electrophotographing system.

Embodiment 3

Referring to FIGS. 11 through 14, the following description will discuss still another embodiment of the present invention.

Figure 11:
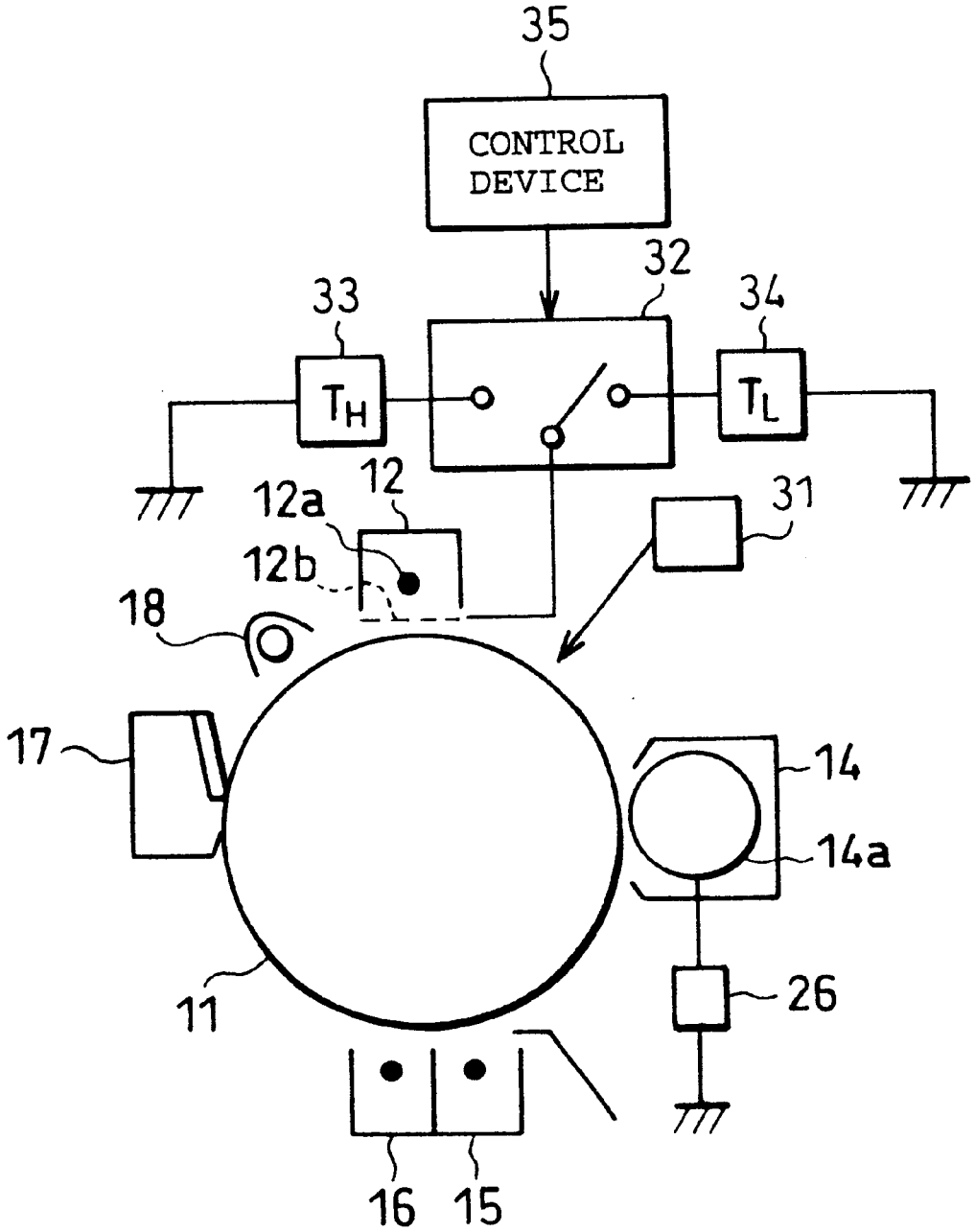
FIG. 11 is a schematic side view that shows the entire structure of an image-forming apparatus in accordance with still another embodiment of the present invention.

As illustrated in FIG. 11, the image-forming apparatus of the present embodiment is provided with a photoreceptor drum 11, and around this photoreceptor drum 11 are installed a charger (charging means) 12, a laser scanning unit (hereinafter, referred to as LSU 31) 31, a developing device (developing means) 14, a transfer device 15, a separation device 16, a cleaning device 17 and a static-eliminating lamp 18, in this order in the rotation direction of the photoreceptor drum 11.

The outline of the image-forming operation of this image-forming apparatus is the same as that shown in Embodiment 1. In this case, the LSU 31 is installed in place of the exposure device 13 of FIG. 1.

A high voltage power supply (not shown) for outputting a high voltage of several kV is connected to the discharging wire 12*a*. To a control grid 12*b* are connected, through a switch (control voltage supply means) 32, a high voltage power supply (control voltage supply means) 33 having a high voltage transformer ($T_H$) and a low voltage bias power supply (control voltage supply means) 34 that is a constant voltage power supply and has a low voltage transformer ($T_L$). In the present embodiment, the output voltage of the lower voltage bias power supply 34 is set in the range of −100 to −200V, and the output voltage of the high voltage power supply 33 is set to approximately −1000V.

The switching operation of the switch 32 is controlled by, for example, a controller 35 provided with a microcomputer.

Figure 12:
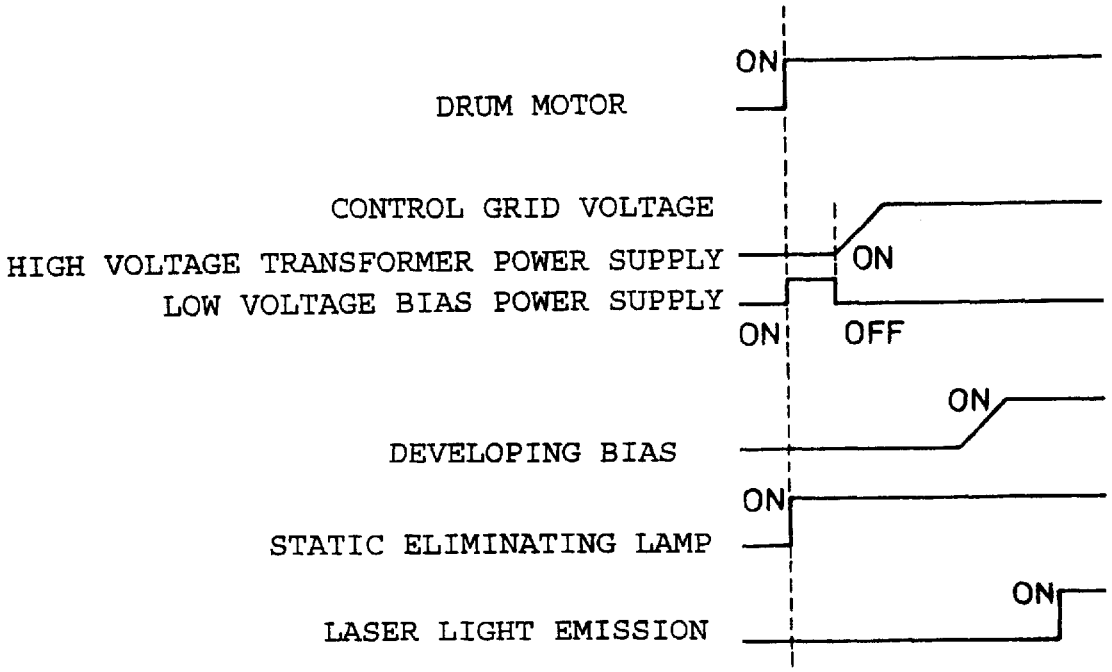
FIG. 12 is a timing chart that shows operation timings of respective parts of the image-forming apparatus shown in FIG. 11.

In the present image-forming apparatus having the above-mentioned construction, a sequence of the image-forming operations is carried out as described above. In this case, in a non-image-forming period from the rotation start of the drive motor of the photoreceptor drum 11, that is, a drum motor, to the light-emitting operation in the laser device provided in the LSU 31, the respective parts operate in a manner as shown in FIG. 12.

In other words, simultaneously as the drum motor is started to rotate, the static-eliminating lamp 18 and the charger 12 are turned on. At this time, in the charger 12, a high voltage is applied to the discharging wire 12*a* and the switch 32 is switched to the low voltage bias power supply 34 side; thus, a predetermined low voltage is supplied to the control grid 12*b* from the low voltage bias power supply 34.

Next, the switch 32 is switched to the high voltage power supply 33 side so that a predetermined high voltage is supplied to the control grid 12*b*, and this high voltage is maintained from this time on. Thereafter, a developing bias is applied to the developing roller 14*a* of the developing device 14, and the laser light emission is then started.

The timing in which the switching is made from the low voltage bias power supply 34 side to the high voltage power supply 33 side by the above-mentioned switch 32 is set at the point of time, for example, after the surface electric potential of the photoreceptor drum 11 rises after the voltage application from the low voltage bias power supply 34 to the control grid 12*b*. Moreover, switching of the voltages is carried out so as not to discontinue the voltage application to the control grid 12*b*.

Figure 13:
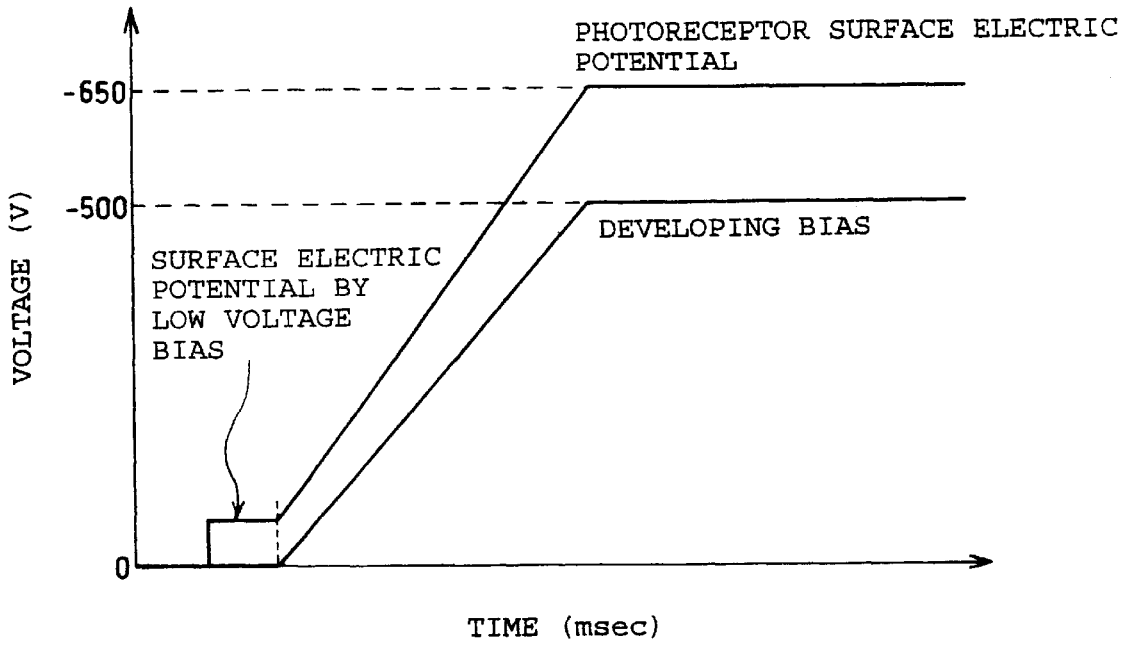
FIG. 13 is a graph that shows the relationship between the surface electric potential of a photoreceptor and the developing bias at the time of its rise in the image-forming apparatus shown in FIG. 11.

As described above, upon application of an electric potential from the charger 12, the surface electric potential of the photoreceptor drum 11 first becomes an electric potential attained by the application of the low voltage bias to the control grid 12*b* as shown in FIG. 13, and is then allowed to rise by applying a high voltage to the control grid 12*b*, thereby finally reaching a predetermined electric potential. By using such a process, the photoreceptor surface electric potential is allowed to rise smoothly in a linear fashion after application of the high voltage to the control grip 12*b* from the high voltage power supply 33.

In other words, the photoreceptor surface electric potential is first allowed to rise temporarily by the application of the low voltage bias to the control grid 12*b* so that the photoreceptor surface can cope with the abrupt electric potential change during the initial rising state to the main electric potential by the high voltage power supply 33. Here, since the rounding 111 (see FIG. 31) occurs at the initial state at the time of the high-voltage application as described earlier, it is possible to reduce the occurrence thereof.

Therefore, as shown in the same Figure, the electric potential difference between the photoreceptor surface electric potential and the developing bias, that is, the so-called fog electric potential ((developing bias electric potential)—(photoreceptor surface electric potential)) is allowed to stably vary without an excessive increase. In other words, the fog electric potential does not expand beyond the stable range of the electric potential (the electric potential difference between −650V of the photoreceptor surface electric potential and −500V of the developing bias); thus, it is possible to control the fog electric potential in a manner so as not to exceed a predetermined value. Consequently, it becomes possible to prevent the carrier rise, that is, the adhesion of carrier to the photoreceptor surface due to carrier dispersion from the developing device 14, and the PC fog, that is, the adhesion of toner to the photoreceptor surface due to toner dispersion from the developing device 14. Moreover, since it is not necessary to use an expensive power supply having a superior rising property as the power supply for the control grid 12*b*, the construction can be achieved at low costs.

In contrast, in the conventional image-forming apparatus, the fog electric potential increases excessively due to the rounding 111 (see FIG. 31). In this case, the fog electric potential is approximately 500V at the generation point of the rounding 111, and the maximum value of the fog electric potential in the conventional apparatus is considered to be 500V to 600V.

Moreover, as illustrated in FIGS. 4 and 5, in the present Embodiment, the PC fog can be reduced by setting the fog electric potential in the range of 50 to 400V and also stabilized by setting it in the range of 100 to 200 V.

In particular, by setting the fog electric potential in the range of 100 to 200V, it is possible to stably reduce the adhesion of reversely charged, weakly charged, or zero-charged toner to the photoreceptor drum 11, and also to eliminate problems caused by carrier dispersion. As a result, it becomes possible to prevent toner dispersion, degradation in the toner consumption, and deterioration of the photoreceptor drum, and consequently to maintain superior image quality for a long time.

As described above, the present image-forming apparatus allows the photoreceptor surface electric potential to smoothly rise and the fog electric potential to stably vary; therefore, it is possible to prevent problems, such as degradation in the copied image quality due to the PC fog value out of the permissible range and the resulting toner dispersion and an increase in toner consumption.

Moreover, in the present embodiment also, the range of the fog potential that can reduce both the carrier rise and the PC fog to permissible ranges is from 50 to 400V, and the present image-forming apparatus makes it possible to maintain the fog electric potential in this range as described above.

Moreover, in the non-image-formation period among periods in which the photoreceptor drum 11 is driven, the photoreceptor surface electric potential should be maintained on the minus side as compared with the developing bias electric potential.

Figure 14:
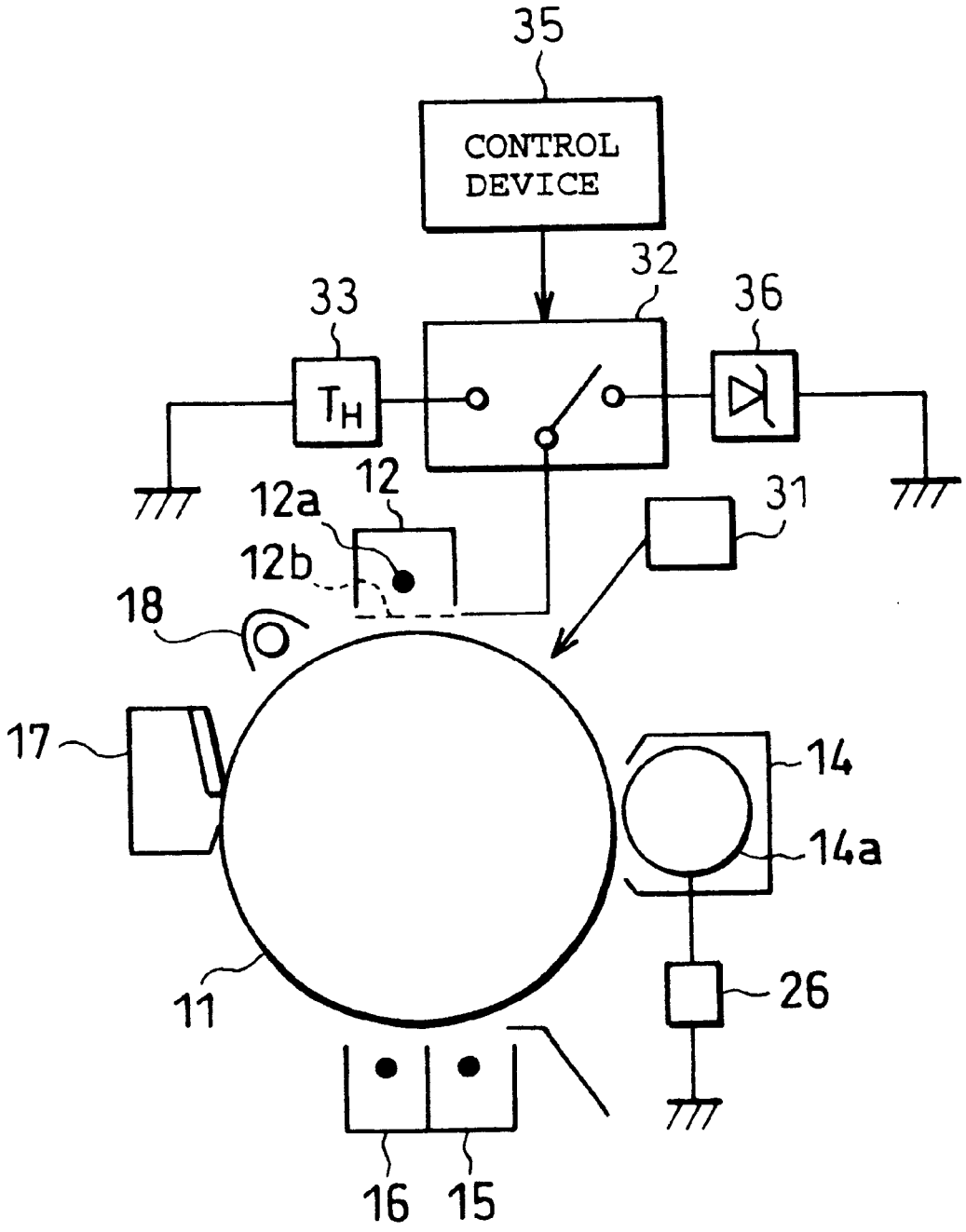
FIG. 14 is a schematic side view that shows the entire structure of an image-forming apparatus in which a power supply consisting of a Zener diode is adopted as a low-voltage power supply for a control grid power supply in the image-forming apparatus shown in FIG. 11.

Moreover, the image-forming apparatus, shown in FIG. 11, may be modified to have an arrangement shown in FIG. 14. In this arrangement, instead of the low voltage bias power supply 34 using a low voltage transformer ($T_L$), a low voltage bias power supply (control voltage supply means) 36 using a Zener diode is provided. In this arrangement, since the Zener diode is used instead of the low voltage transformer ($T_L$), it is possible to simplify and miniaturize the construction.

Furthermore, instead of the low voltage bias power supply 36 using the Zener diode, a construction using a power supply constituted by capacitor elements may be adopted. This case also makes it possible to simplify and miniaturize the construction, and also to reduce costs.

Embodiment 4

Referring to FIGS. 15 through 22, the following description will discuss still another embodiment of the present invention. Here, for convenience of explanation, those of the means having the same functions as the means shown in the aforementioned drawings are indicated by the same reference numerals and the description thereof is omitted.

As shown in FIG. 13, in the image-forming apparatus shown in FIG. 11, the photoreceptor surface has a minus charge in the low voltage bias application region to the control grid 12*b*. At this time, the photoreceptor surface tends to have an irregular electric potential depending on environments, fatigue after a long-term use, etc., and the fog electric potential tends to become unstable. In the present image-forming apparatus, in order to stabilize the fog electric potential at the time of the application of the low voltage bias to the control grid 12*b*, the electric potential of the photoreceptor surface, attained by the application of a voltage from the low voltage bias power supply 34 to the control grid 12*b*, is cancelled to 0V.

Figure 15:
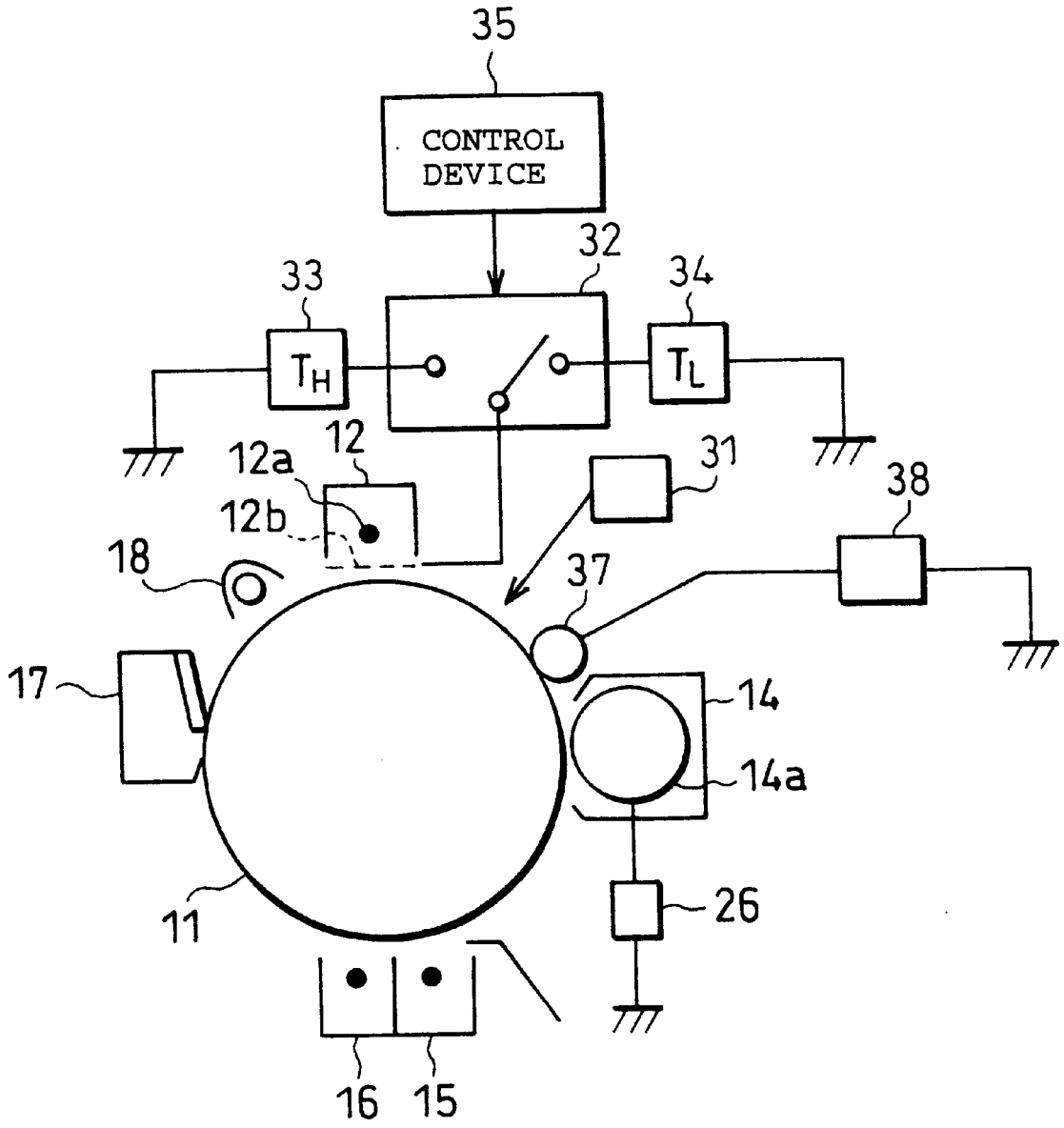
FIG. 15 is a schematic side view that shows the entire structure of an image-forming apparatus in which a charging roller is provided as an electric potential eliminating means so as to set a surface electric potential of the photoreceptor generated by a low-voltage bias to 0 V in the image-forming apparatus of FIG. 11.

(1) Construction for applying a reversely polarized bias As illustrated in FIG. 15, the image-forming apparatus of the present embodiment has an arrangement in which a charging roller (electric potential eliminating means, contact member)

37 forming the second charging means is further added to the image-forming apparatus shown in FIG. 11 having the charger 12 as the first charging means. The charging roller 37 is installed between the charger 12 and the developing device 14 on the periphery of the photoreceptor drum 11, and allowed to contact the surface of the photoreceptor drum 11. The charging roller 37 has a two-layer structure having a conductive elastic layer placed around a core roller. A reversed polarity bias power supply (electric potential eliminating means, electric potential eliminating power supply) 38 is connected to the charging roller 37. This reversed polarity bias power supply 38 is designed to output a voltage that has a reversed polarity to the output voltage of the low voltage bias power supply 34, and also has the same electric potential as the electric potential that is supplied to the photoreceptor surface upon application of the voltage of the low voltage bias power supply 34 to the control grid 12*b*.

Figure 16:
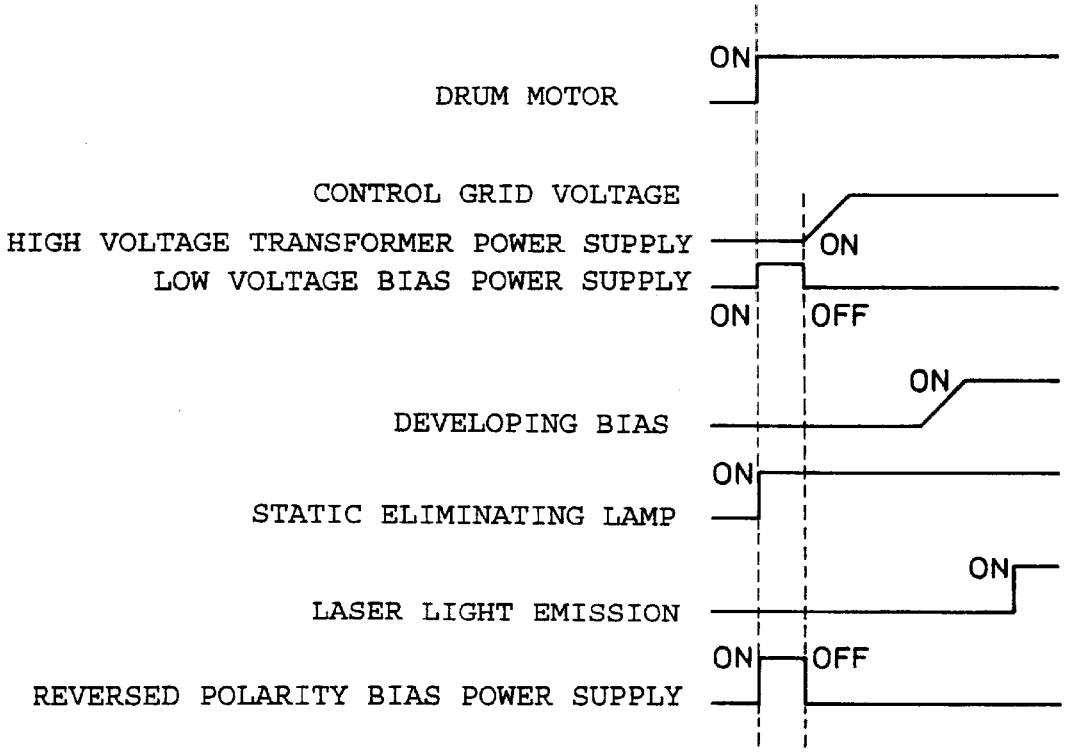
FIG. 16 is a timing chart that shows operation timings of respective parts of the image-forming apparatus shown in FIG. 15.

The operation timings in the respective parts in the image-forming apparatus, which are shown in FIG. 16, are identical to those shown in FIG. 12 of the image-forming apparatus of FIG. 11, except the operation of the reversed polarity bias power supply 38.

The reversed polarity bias power supply 38 is turned on virtually simultaneously as the low voltage bias power supply 34 is turned on, and turned off virtually simultaneously as the low voltage bias power supply 34 is turned off. In other words, the reversed polarity bias power supply 38 cancels the electric potential of the photoreceptor surface supplied by the voltage application from the low voltage bias power supply 34 to the control grid 12*b*, by supplying the electric potential having the reversed polarity and the same level to the photoreceptor surface through the charging roller 37, so as to set the photoreceptor surface electric potential to 0V.

Figure 17:
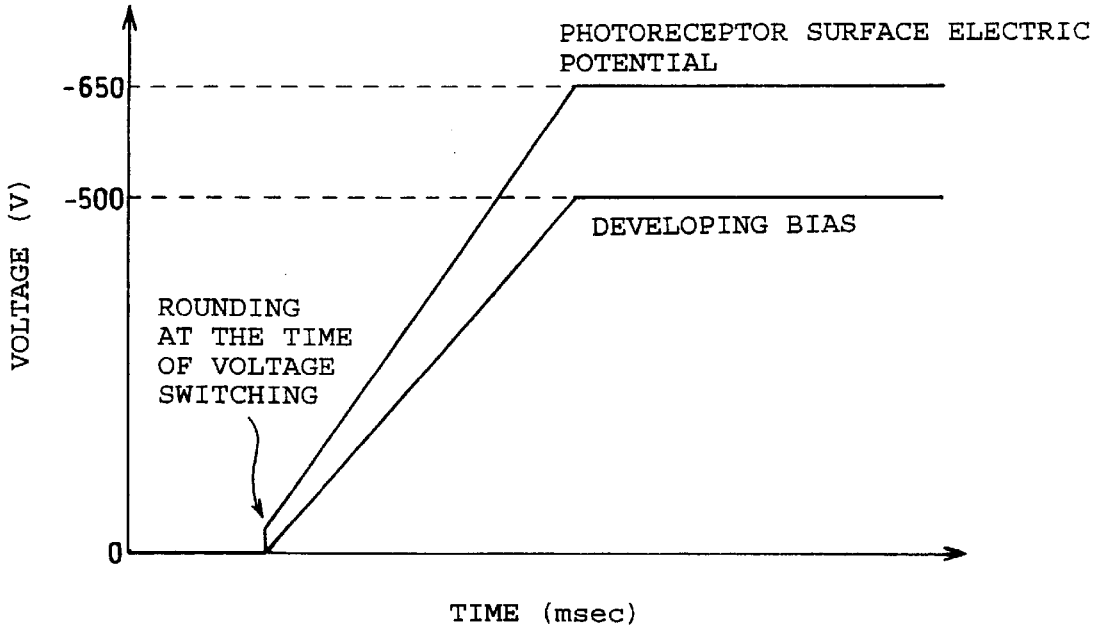
FIG. 17 is a graph that shows the relationship between the surface electric potential of a photoreceptor and the developing bias at the time of its rise in the image-forming apparatus shown in FIG. 15.

This arrangement makes it possible to stabilize the fog electric potential at the time of the application of the low voltage bias to the control grid 12*b*, and also to further linearize the transition of the surface electric potential as shown in FIG. 17. As a result, it becomes possible to more positively prevent the carrier rise and the PC fog.

Moreover, in this construction having the charging roller 37 that directly contacts the photoreceptor surface, it is possible to miniaturize the apparatus and to reduce power consumption without the need for a high voltage supply as the reversed polarity bias power supply 38.

Figure 18:
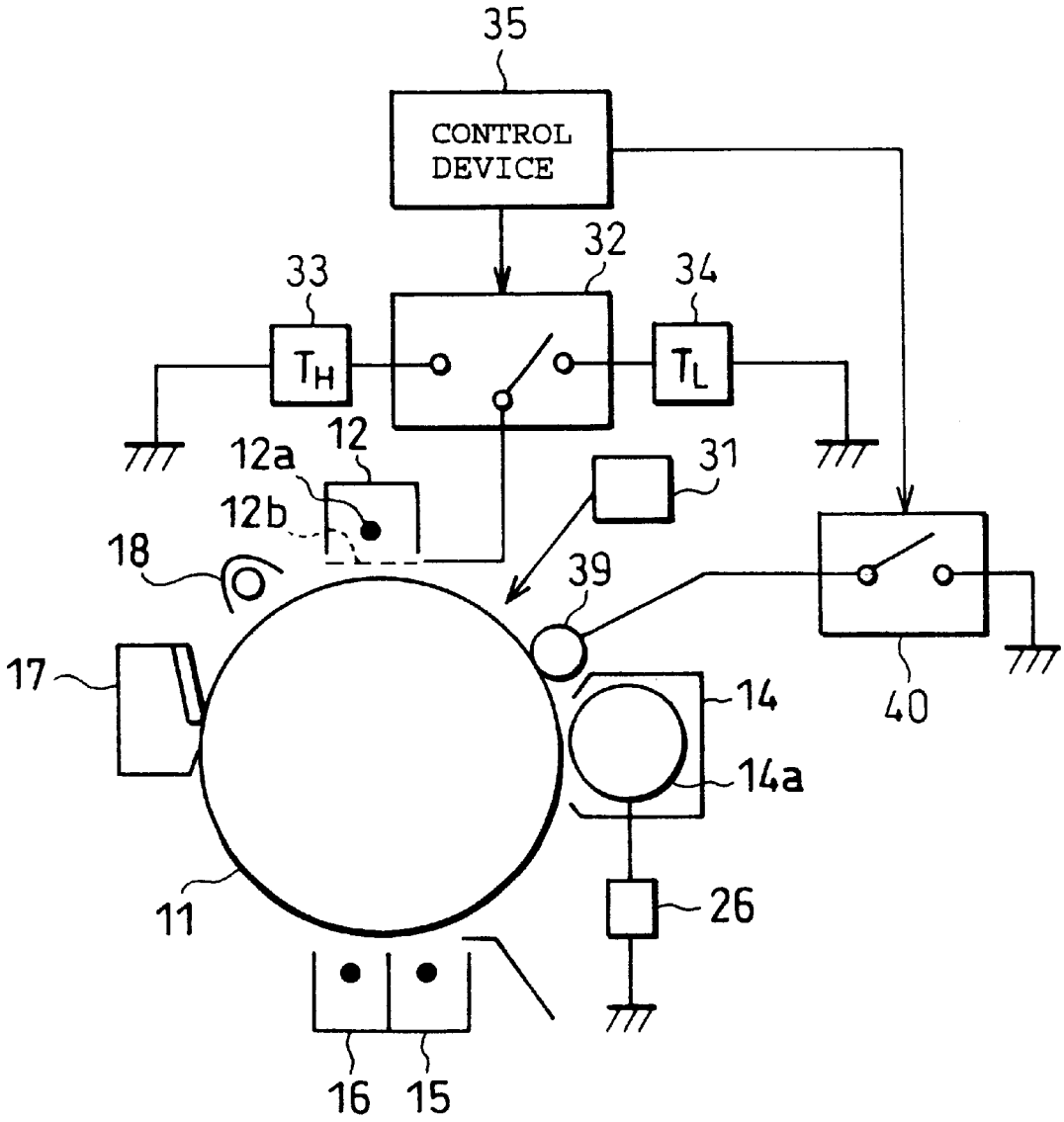
FIG. 18 is a schematic side view that shows the entire structure of an image-forming apparatus in which a conductive roller is provided in place of the charging roller in the image-forming apparatus shown in FIG. 15.

Moreover, the image-forming apparatus of the present embodiment preferably has a construction shown in FIG. 18. In this construction, a conductive roller (electric potential eliminating means) 39 made of metal is provided instead of the charging roller 37, and this conductive roller 39 can be grounded through a switch (electric potential eliminating means, ground/non-ground switching means) 40. The conductive roller 39 is also allowed to directly contact the photoreceptor surface in the same manner as the charging roller 37.

The ON/OFF timing of the switch 40 is virtually the same as the ON/OFF timing of the reversed polarity bias power supply 38. This construction makes it possible to provide the same functions as the construction shown in FIG. 15.

Moreover, this construction eliminates the need for the reversed polarity bias power supply, provides a simple structure, provides easy control, and also provides low costs.

Figure 19:
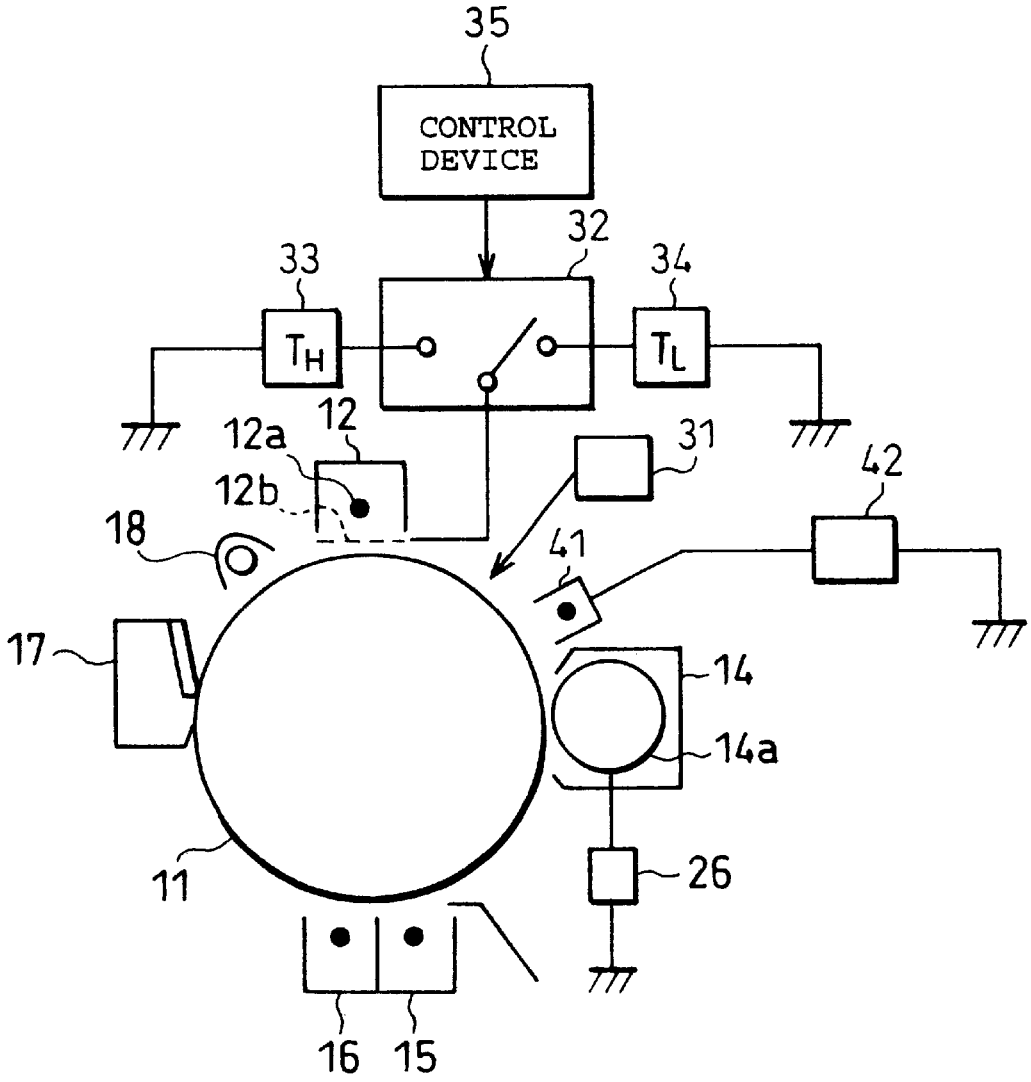
FIG. 19 is a schematic side view that shows the entire structure of an image-forming apparatus in which a corona charger is provided in place of the charging roller in the image-forming apparatus shown in FIG. 15.

Furthermore, the image-forming apparatus of the present embodiment preferably has a construction shown in FIG. 19. In this construction, a charger (electric potential eliminating means, discharging means) 41 for carrying out corona discharging is provided instead of the charging roller 37 shown in FIG. 15, and a reversed polarity bias power supply (electric potential eliminating means) 42 that functions in the same manner as the reversed bias power source 38 is connected the charger 41. In the construction where contact charging is carried out by the charging roller 37 and the conductive roller 39, since these rollers 37 and 39 always slide on the photoreceptor surface, the photoreceptor surface tends to be subjected to a film reduction and scratches, thereby giving adverse effects on the longevity of the photoreceptor drum 11. In contrast, the charger 41 that carries out corona discharging is free from such problems.

Figure 20:
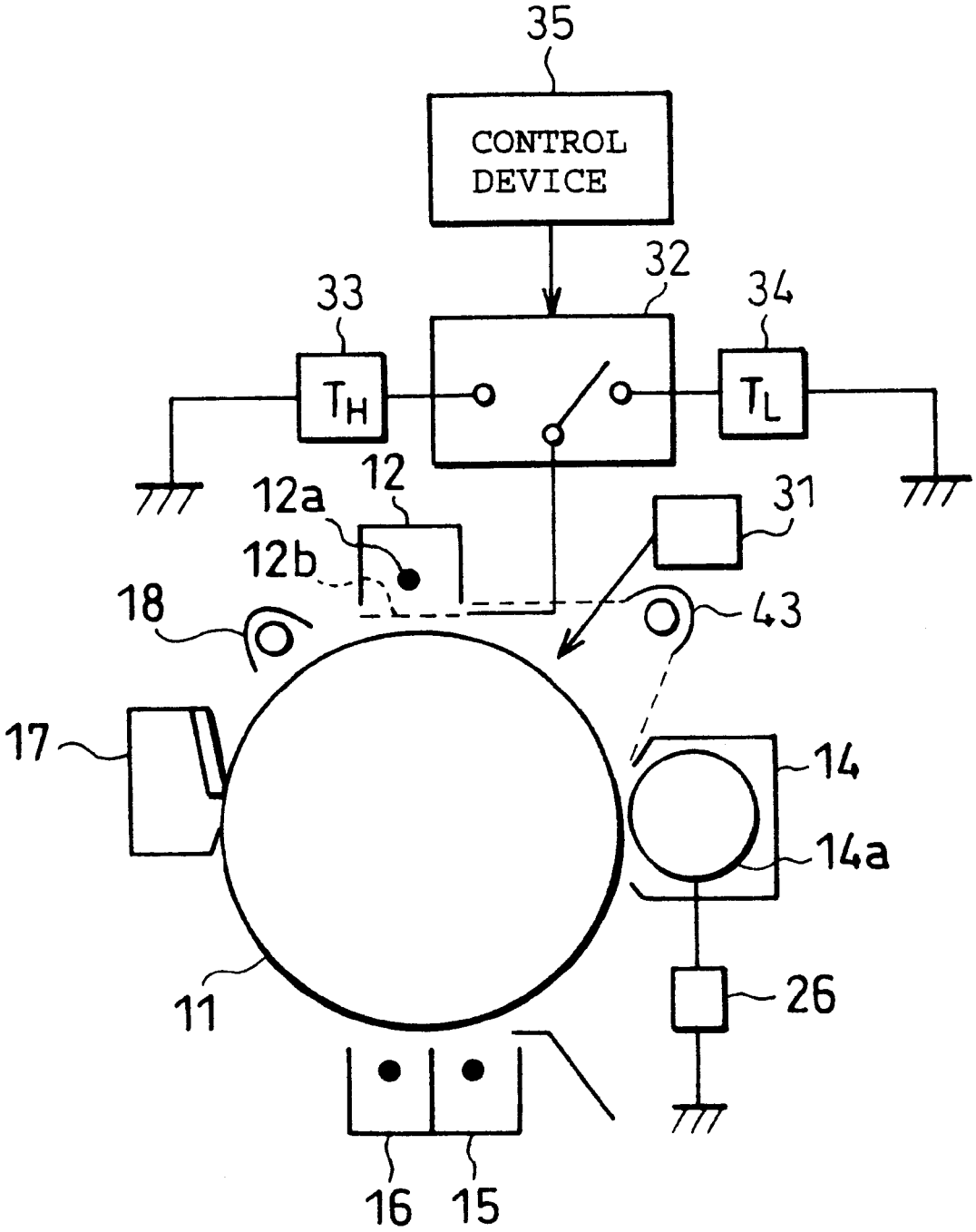
FIG. 20 is a schematic side view that shows the entire structure of an image-forming apparatus in which a static eliminating light source provided as an electric potential eliminating means of the photoreceptor surface so as to set a surface electric potential of the photoreceptor generated by a low-voltage bias to 0 V in the image-forming apparatus of FIG. 11.

(2) Construction for eliminating static electricity from the photoreceptor surface As illustrated in FIG. 20, the image-forming apparatus of the present embodiment is provided with a static eliminating light source (electric potential eliminating means) 43 serving as a static eliminating means that is interpolated between the charger 12 and the developing device 14, instead of the charging roller 37 in the image-forming apparatus shown in FIG. 15. Light irradiation from the static eliminating light source 43 allows the surface electric potential of the photoreceptor to be set to 0V.

(3) Construction using LSU 31

Figure 21:
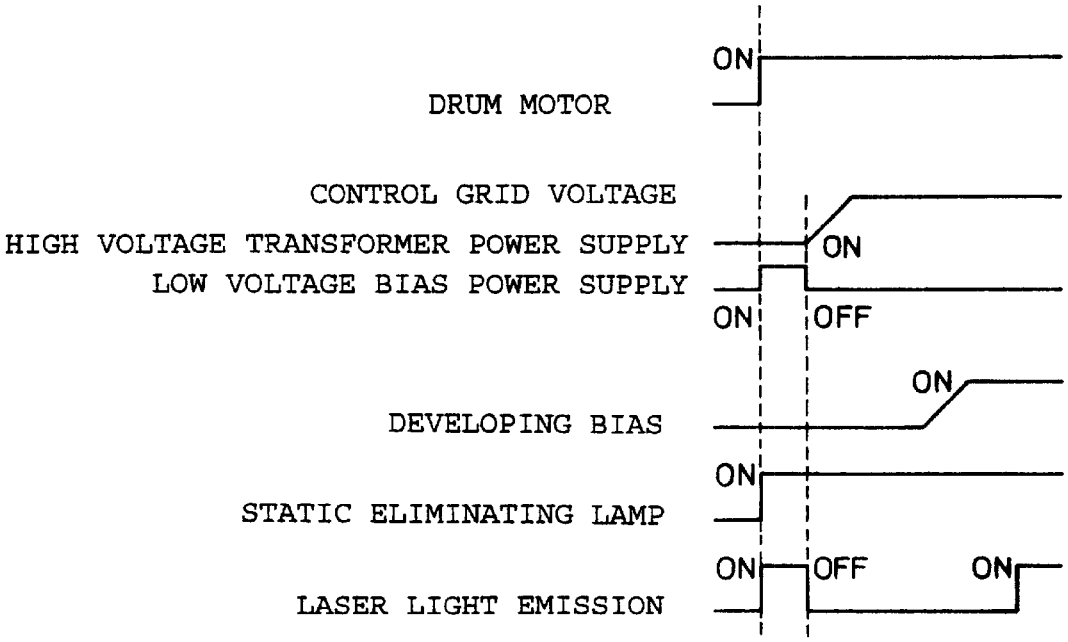
FIG. 21 is a timing chart that shows operation timings of respective parts of the image-forming apparatus shown in FIG. 20, in which an LSU is utilized in place of the static eliminating light source shown in FIG. 20.
Figure 22:
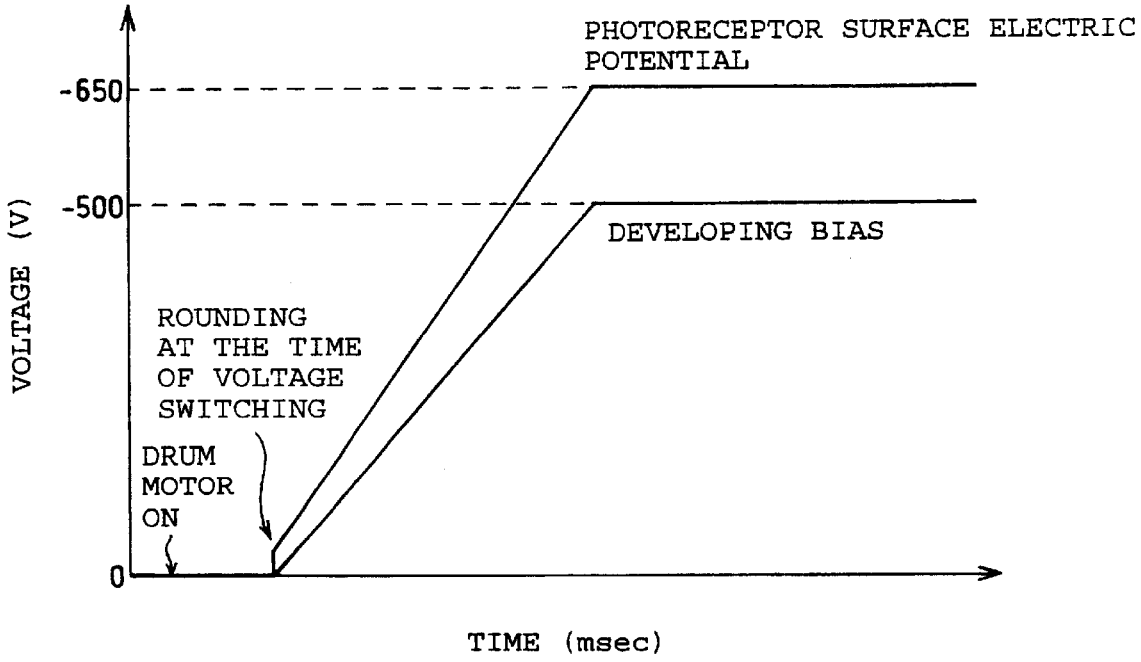
FIG. 22 is a graph that shows the relationship between the surface electric potential of the photoreceptor and the developing bias at the time of rising in the operations shown in FIG. 21.

In the image-forming apparatus of the present embodiment, an LSU 31 is utilized so as to eliminating the surface electric potential of the photoreceptor drum 11. In digital copying machines and printers, a scanner optical system is provided below the document platen. The scanner optical system is constituted by an exposing light source for directing light to an original document and optoelectric transducers such as CCD for reading light reflected from the original document. The document image data, read by the CCD, etc., is subjected to an image processing operation by the LSU 31, and outputted as a laser light beam. The LSU 31 corresponds to a light source such as a halogen lamp used in analog machines. In the present image-forming apparatus, as illustrated in FIG. 21, the LSU 31 is allowed to emit light at the time of applying a low voltage bias to the control grid 12*b* so as to set the photoreceptor surface electric potential to 0V. As a result, the relationship between the photoreceptor surface electric potential and the developing bias at the time of rising, indicated in FIG. 22, is obtained, which is similar to that shown in FIG. 17.

Embodiment 5

Referring to FIGS. 15, and 23 through 26, the following description will discuss still another embodiment of the present invention. Here, for convenience of explanation, those of the means having the same functions as the means shown in the aforementioned drawings are indicated by the same reference numerals and the description thereof is omitted.

Figure 23:
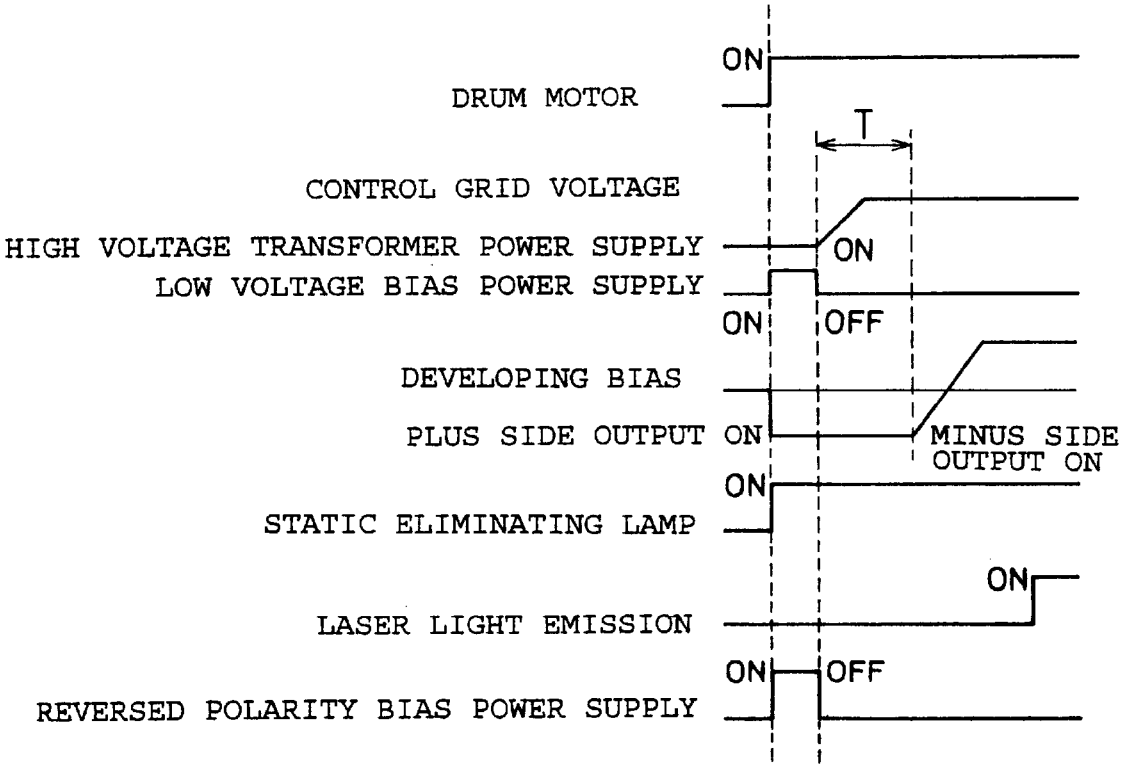
FIG. 23 is a timing chart that shows operation timings of respective parts in the case when, during a period in which a charged area to the surface electric potential of the photoreceptor, formed by a voltage application from a high-voltage power supply to the control grid, has reached the developing section, the developing bias is applied as a plus-side output, in an image-forming apparatus in accordance with still another embodiment of the present invention.

The present image-forming apparatus, which has the same construction, for example, as shown in FIG. 15, is designed so that the output voltage of the developing bias power supply 26 can be varied, with the result that the developing bias to the developing roller 14*a* is controlled as follows:

In other words, as illustrated in FIG. 23, with respect to the developing bias, a low voltage (minus side output) is applied to the control grid 12*b* of the charger 12 by the low voltage bias power supply 34, and simultaneously as the drum motor starts to rotate, a voltage of the plus side output is applied, and thereafter, a normal developing bias of the minus side output is applied. The voltage of the plus side output to be applied to the control grid 12*b* has the same polarity as that of the control voltage applied as the developing bias and the toner charging polarity. The plus side output has a voltage of, for example, +150V, and the period for applying this voltage is set to a period during which, after the drum motor has been turned on, a charged area on the surface of the photoreceptor by the voltage application from the high voltage power supply 33 to the control grid 12*b* reaches the developing section, that is, the opposing portion of the photoreceptor drum 11 and the developing roller 14*a*. The portion of the photoreceptor drum 11 which is allowed to pass through the developing section during this period has a surface electric potential of OV by the function of the charging roller 37.

Here, the voltage of the plus side output in the developing bias is not intended to be limited to +150V, and is preferably set in the range of +50 V to +400 V from the results as shown in FIG. 4 and FIG. 5, since the photoreceptor surface electric potential is 0V.

Moreover, T in FIG. 23 represents a period from the time when the voltage application from the high voltage power supply 33 to the control grid 12*b* has started to the time when the minus side output of the developing bias is turned on, and this period corresponds to time in which the photoreceptor surface reaches the developing device 14 from the charger 12.

Figure 24:
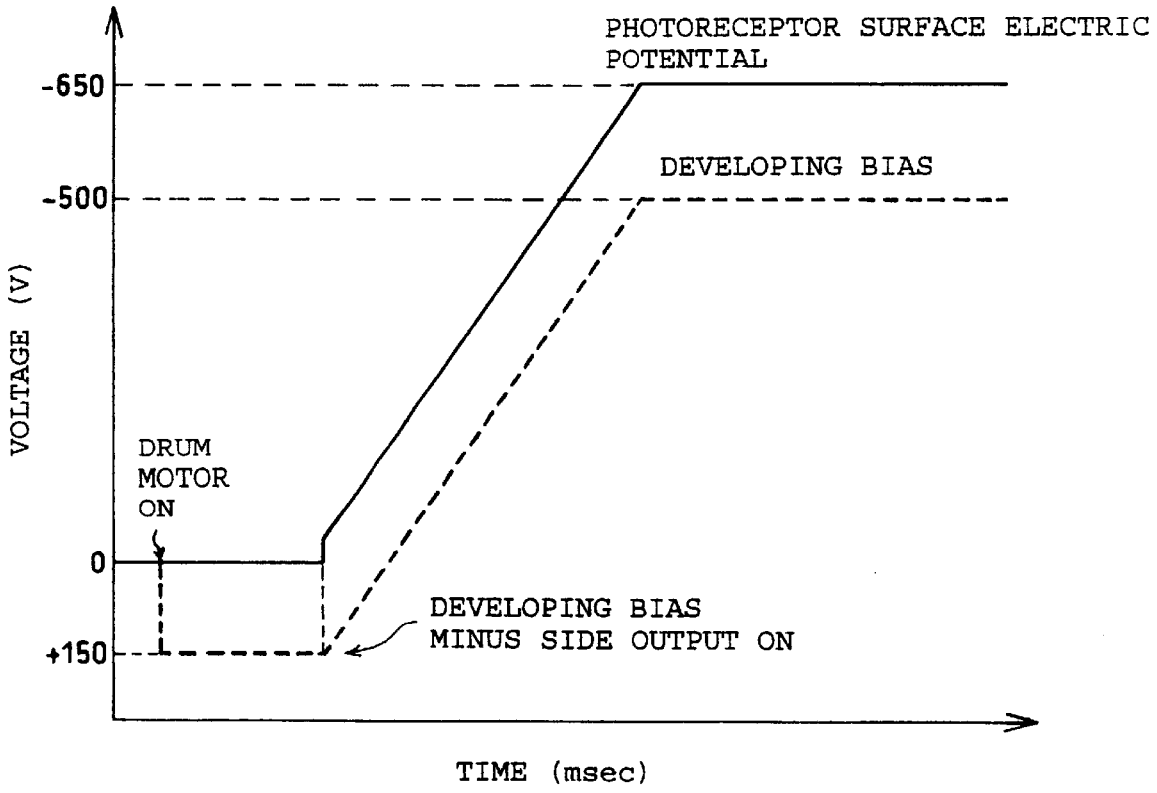
FIG. 24 is a graph that shows the relationship between the surface electric potential of the photoreceptor and the developing bias at the time of rising in the operations shown in FIG. 23.

As illustrated in FIG. 24, by controlling the developing bias as described above, the fog electric potential can be stably maintained at a virtually constant value from the initial state of the rise of the photoreceptor surface electric potential. Thus, it is possible to positively prevent the PC fog caused by an excessively small fog electric potential (a fog electric potential of less than 50V as shown in FIG. 5).

Figure 25:
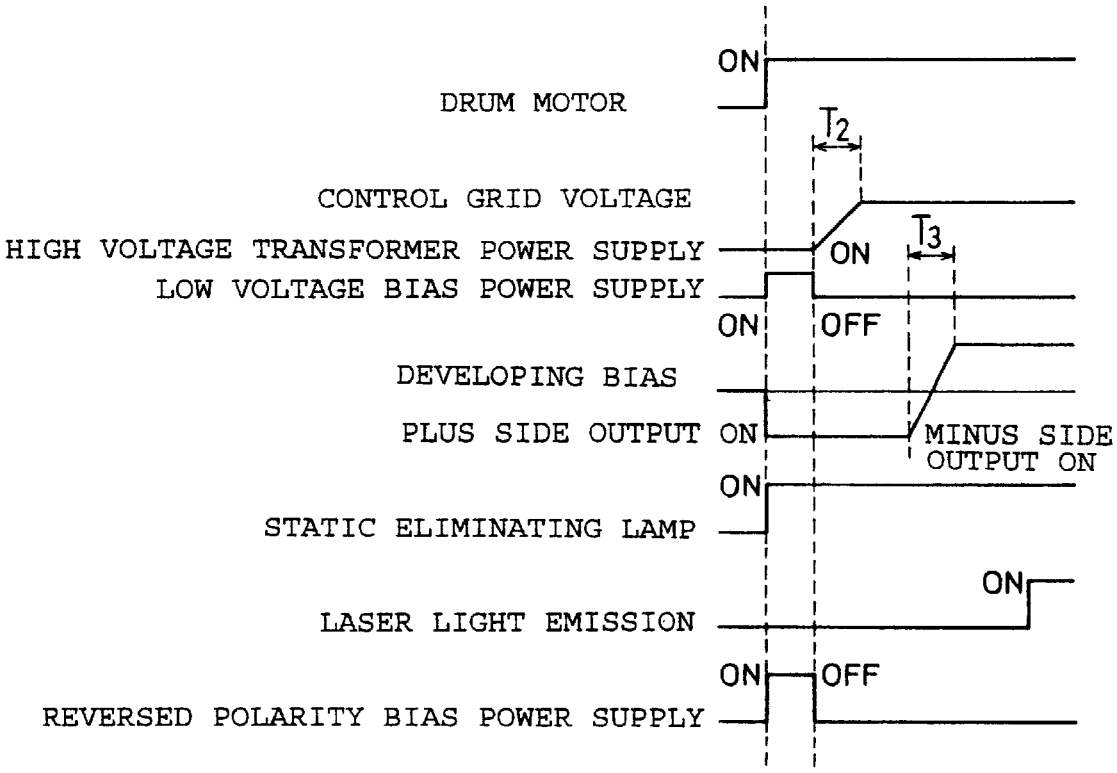
FIG. 25 is a timing chart that shows operation timings of respective parts which include and show periods of time required for the photoreceptor surface electric potential and the developing bias to reach predetermined electric potentials in the image-forming apparatus shown in the respective embodiments of the present invention.
Figure 26:
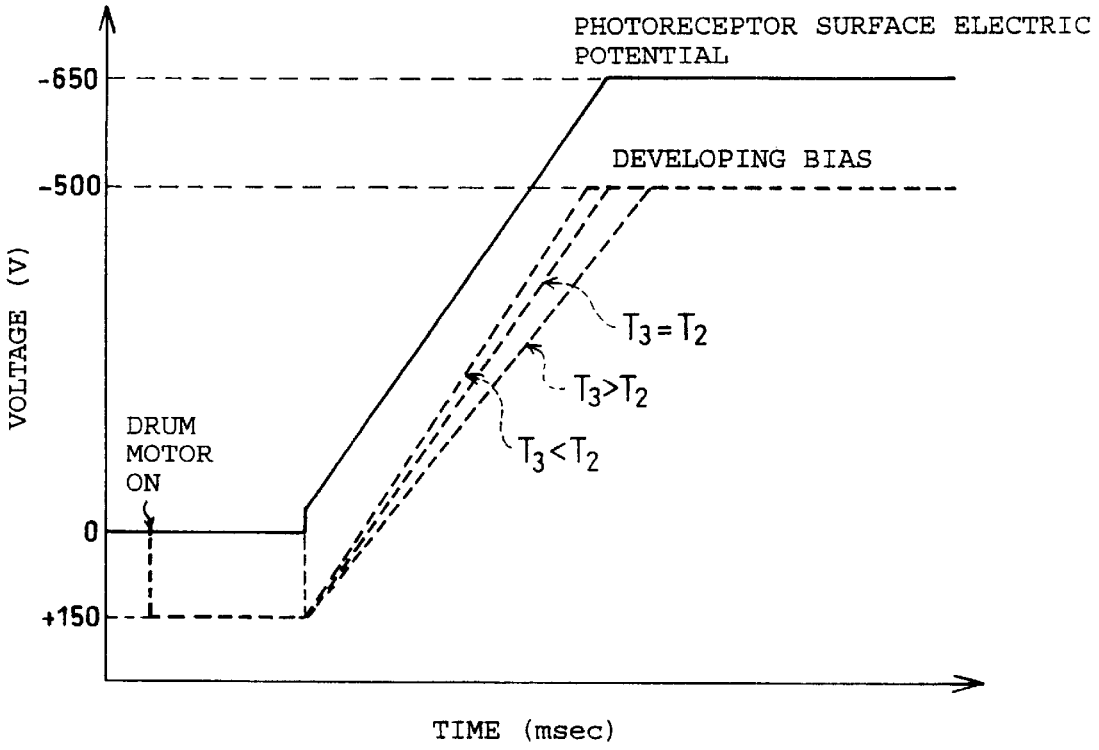
FIG. 26 is a graph that shows the relationship between the surf ace electric potential of the photoreceptor and the developing bias at the time of rising, in association of the size relationship of the respective period of times required shown in FIG. 25.

Moreover, for example, in the present image-forming apparatus, the relationship between the time it takes from the start of the voltage application from the high voltage power supply 33 to the control grid 12*b* to the arrival of the photoreceptor surface electric potential to a predetermined value, that is, the time required for the surface electric potential $T_2$, and the time it takes from the developing bias application to the arrival to a predetermined value, that is, the time required for the developing bias $T_3$, is shown in FIGS. 25 and 26.

In FIG. 26, when $T_3>T_2$, the fog electric potential becomes greater immediately before the arrivals of the photoreceptor surface electric potential and the developing bias to the predetermined values. In contrast, when $T_3 \leqq T_{a2}$, the fog electric potential does not become greater, thereby making it possible to prevent carrier dispersion (carrier rise) from the developing device 14.

Therefore, by making the time required for the developing bias $T_3$ 10 to 50 msec shorter than the time required for the surface electric potential $T_2$, it is possible to provide a superior fog electric potential and consequently to obtain stable image characteristics. Here, the size relationship between the time required for the surface electric potential $T_2$ and the time required for the developing bias $T_3$ can be set by using, for example, a voltage control program based on a software.

Embodiment 6

Figure 27:
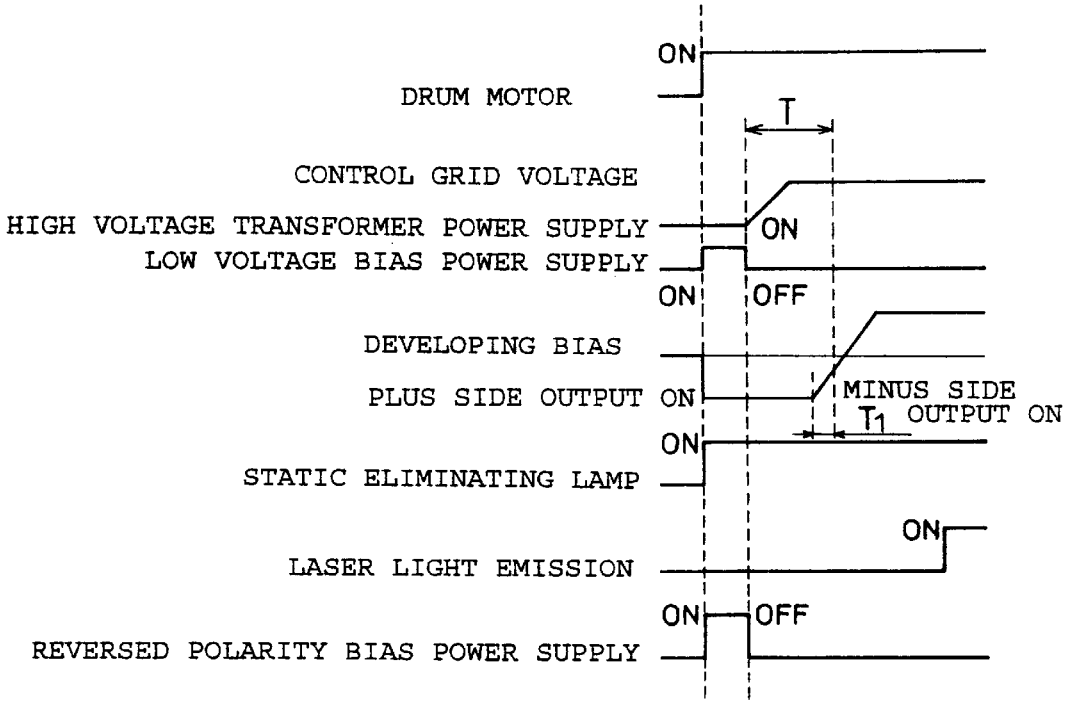
FIG. 27 is a timing chart that shows operation timings of respective parts in the case when the ON timing of the developing bias on the minus side is set to be earlier than the time when the charged area having the photoreceptor surface electric potential resulting from the application of the voltage of the high voltage power supply to the control grid reaches the developing section, in an image-forming apparatus of still another embodiment of the present invention.
Figure 28:
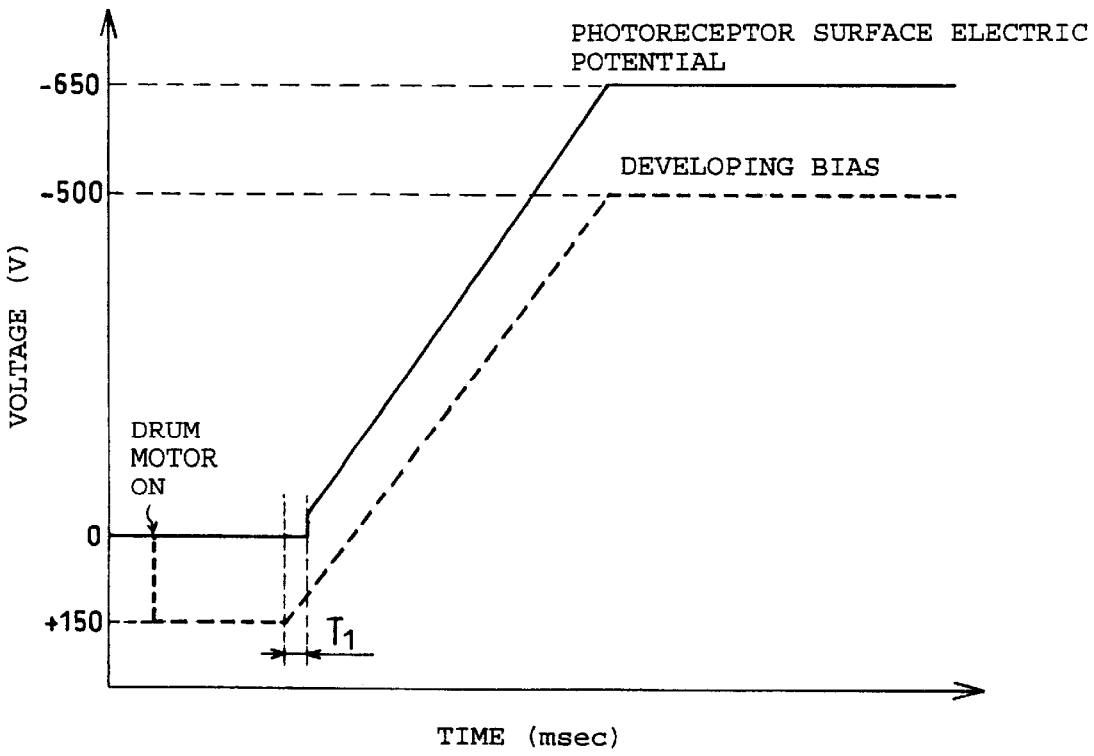
FIG. 28 is a graph that shows the relationship between the surface electric potential of the photoreceptor and the developing bias at the time of rising in the operations shown in FIG. 27.
Figure 29:
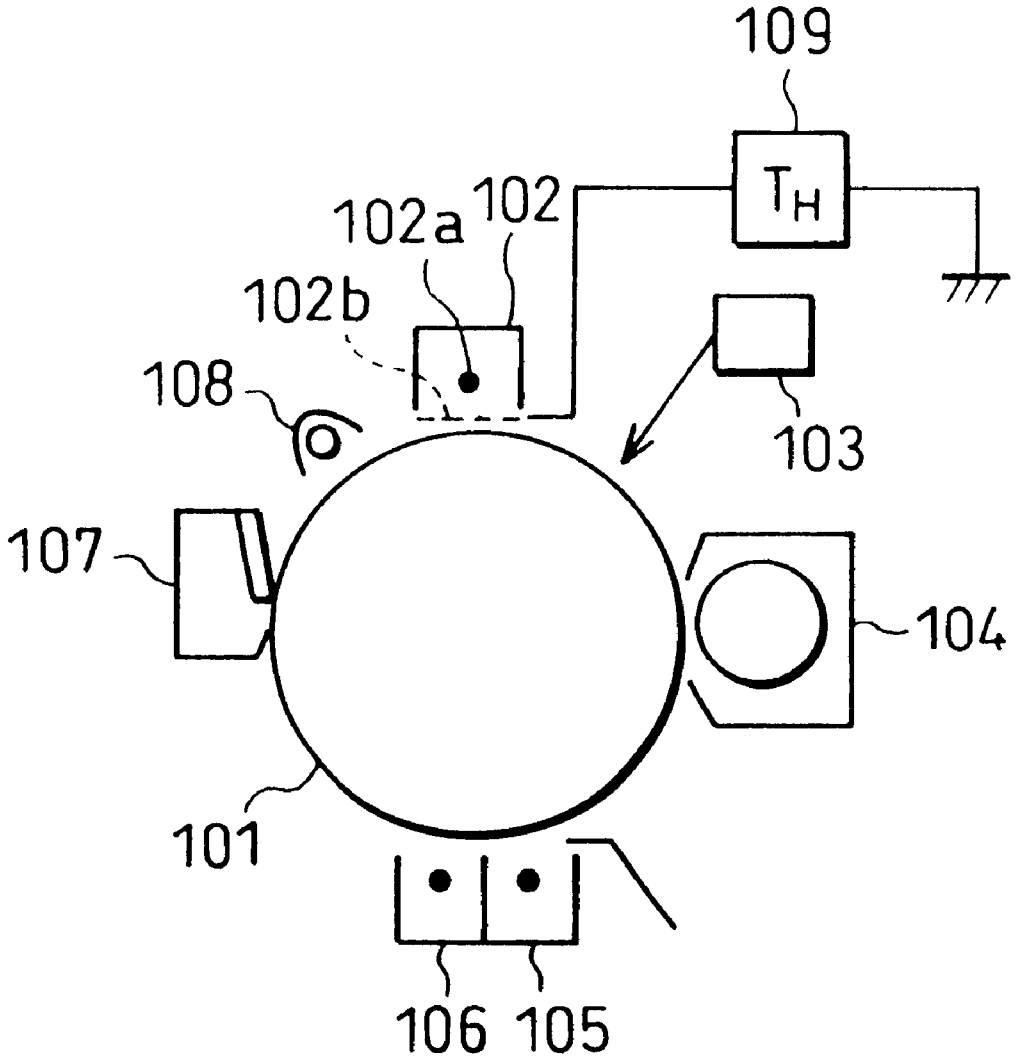
FIG. 29 PRIOR ART
FIG. 29 is a schematic side view that shows the entire structure of a conventional image-forming apparatus.
Figure 30:
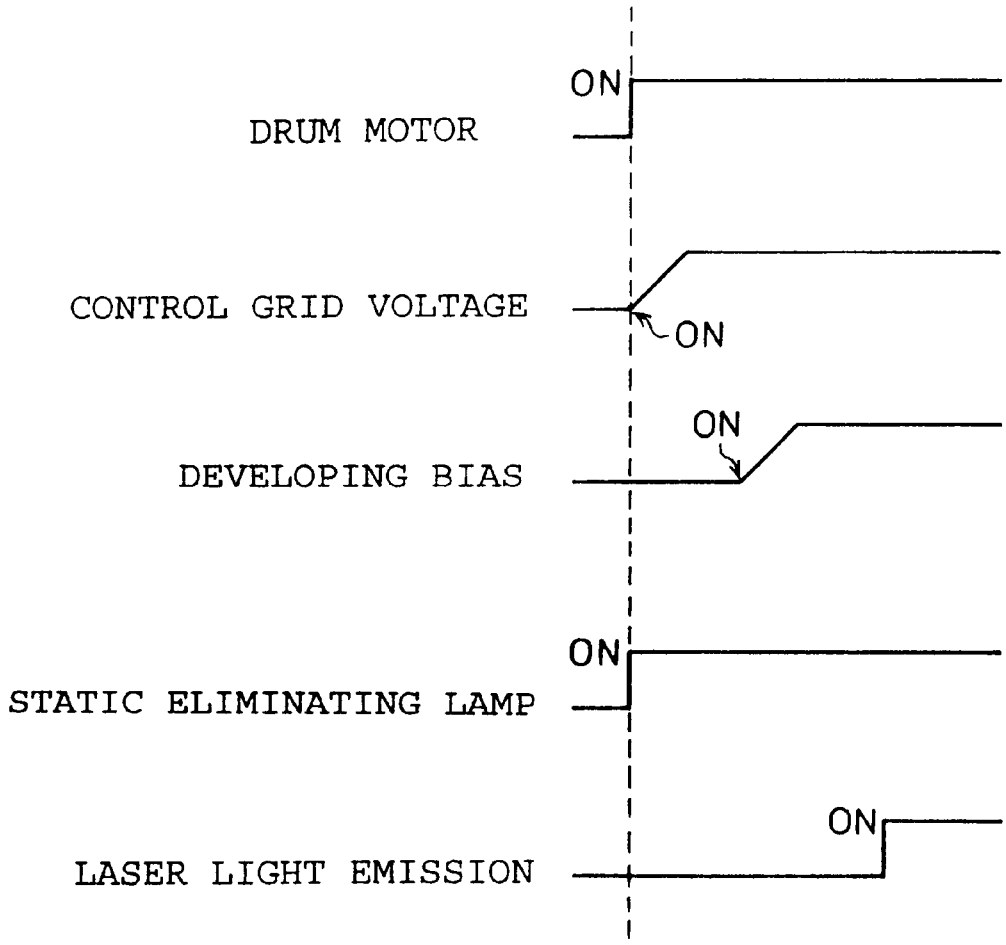
FIG. 30 PRIOR ART
FIG. 30 is a timing chart that shows operation timings of respective parts of the image-forming apparatus shown in FIG. 29.

Referring to FIG. 15 as well as FIGS. 27 and 28, the following description will discuss still another embodiment of the present invention. Here, for convenience of explanation, those means having the same functions as the means shown in the aforementioned drawings are indicated by the same reference numerals and the description thereof is omitted.

In the present image-forming apparatus, for example, in an arrangement shown in FIG. 15, as illustrated in FIG. 20, when, upon controlling the developing bias, a switchover is made from the ON state of the plus side output to the ON state of the minus side output, this switching timing is made time $T_1$ earlier than the arrival of the charged area of the photoreceptor surface made by the voltage application from the high voltage power source 33 to the control grid 12*b* to the developing section.

When the voltage application source to the control grid 12*b* is changed from the low voltage bias power supply 34 to the high voltage power supply 33, a slight increase in the surface electric potential (corresponding to the low voltage bias) occurs and the fog electric potential tends to expand; however, as illustrated in FIG. 28, the above-mentioned control makes it possible to suppress this expansion to a minimum. Here, the time $T_1$ is set to 10 to 50 msec.

Here, the respective image-forming apparatuses use the reversal developing system. In the reversal developing system, an image exposure representative of image information to be recorded is carried out on the surface of the photoreceptor drum 11 uniformly charged, by using a laser beam, an LED, etc., so that an electrostatic latent image is formed thereon, and toner charged with the same polarity as the charged polarity of the photoreceptor drum 11 is allowed to adhere to the portion having an electric potential drop due to the exposure at this time, with the result that a toner image is formed. Therefore, the respective image-forming apparatuses are applicable to digital copying machines, printers, etc. using the electrophotographing system.

Moreover, in the above-mentioned image-forming apparatuses, the two-component contact developing system is used from the viewpoints of ease in toner charging control, high quality images and highly stable images. In this system, a developer formed by mixing a magnetic carrier into a non-magnetic toner is used, and a coating of the non-magnetic toner is formed on a sleeve of the developing roller 14*a* with a blade, etc., and the non-magnetic toner is transported in this state, and made in contact with the photoreceptor drum 11 so as to carry out a developing process. The ferrite carrier having a high electric resistance used in the image-forming apparatuses makes it possible to provide high reproducibility in fine-line images and highlighted images without disturbance in an electrostatic latent image, and consequently to provide images with high precision. Furthermore, the two-component developer having the non-magnetic toner and the magnetic carrier as its main components is effectively used in image-forming apparatuses forming full-color or multi-color images.

In the above-mentioned image-forming apparatuses, the control voltage supply means is preferably designed to have a power supply having a Zener diode as a power supply on the low-voltage side.

With this arrangement, since the control voltage supply means is provided with the Zener diode as a power supply on the low-voltage side, it is possible to simplify the construction and also to miniaturize the apparatus.

Moreover, in the above-mentioned image-forming apparatuses, the control voltage supply means may have one transformer having a plurality of output terminals placed from the low-voltage side to the high-voltage side.

With this arrangement, since the control voltage supply means has only one transformer, it is possible to simplify the construction and also to miniaturize the apparatus.

Furthermore, in the above-mentioned image-forming apparatuses, the developing means is preferably further provided with a developing bias supply means for supplying a developing bias to the developing means so that, during the non-image-forming period in which the photoreceptor is in rotation and no developing operation is carried out by the developing means, the electric potential difference between the surface electric potential of the photoreceptor and the developing bias is maintained in the range of 50 to 400V.

With the above-mentioned arrangement, during the non-image-forming period in which the photoreceptor is in rotation and no developing operation is carried out by the developing means, the electric potential difference between the surface electric potential of the photoreceptor and the developing bias is maintained in the range of 50 to 400V; thus, it is possible to positively reduce the amount of carrier dispersion from the developing means and the amount of adhesion of reversely charged, weakly charged, and zero-charged toner to the photoreceptor. As a result, it becomes possible to prevent deterioration of the photoreceptor due to carrier adhesion onto the photoreceptor surface and an increase in the toner consumption, and consequently to provide images with stable image quality.

In the above-mentioned image-forming apparatuses, the developing means is preferably further provided with a developing bias supply means for supplying a developing bias to the developing means, and this developing bias supply means is designed so that during a period of time it takes for the portion of the photoreceptor surface having an electric potential rise by the application of the control voltage to the control electrode to reach the developing section between the photoreceptor and the developing means, a developing bias having a reversed polarity to the polarity of the control voltage is supplied to the developing means.

With the above-mentioned arrangement, during a period of time it takes for the portion of the photoreceptor surface having an electric potential rise by the application of the control voltage to the control electrode to reach the developing section between the photoreceptor and the developing means, the developing bias having a reversed polarity to the polarity of the control voltage is supplied to the developing means; thus, it becomes possible to prevent dispersion of reversely charged, weakly charged, and zero-charged toner from the developing means during the above-mentioned period and the resulting adhesion onto the photoreceptor surface.

In other words, after the start of the rotation of the photoreceptor, in the case when, during a period of time it takes for the portion of the photoreceptor surface having an electric potential rise by the application of the control voltage to the control electrode to reach the developing section, the developing bias remains at 0V, since the surface electric potential of the portion of the photoreceptor passing through the developing section is 0V, the portion is subjected to toner adhesion. Here, when a voltage having the same polarity as the control voltage is applied as a developing bias at this time, the photoreceptor surface is subjected to toner adhesion regardless of the intensity of the toner charge.

For this reason, during the above-mentioned period, the voltage having the reversed polarity to the control voltage is applied to the developing means so that it becomes possible to prevent adhesion of toner to the photoreceptor surface. Consequently, it is possible to prevent an increase in the toner consumption and to provide images with stable image quality.

In the image-forming apparatus of the present invention is preferably with: a rotatable photoreceptor; a charging means for charging the surface of the photoreceptor to a predetermined electric potential by means of corona discharging, the charging means being provided with a control electrode for controlling the quantity of corona ions that are allowed to reach the photoreceptor from a discharging electrode; a latent image forming means for forming an electrostatic latent image on the photoreceptor that has been charged by the charging means by means of light irradiation; a developing means for developing the electrostatic latent image by using a developer; and a control voltage supply means which supplies a control voltage to the control electrode and which, upon allowing the photoreceptor surface electric potential to rise to the predetermined electric potential, during the non-image-forming period in which the photoreceptor is in rotation and no developing operation is carried out by the developing means, first supplies a low voltage bias as the control voltage so as to allow the photoreceptor surface to rise to a predetermined low electric potential, and then supplies a control voltage on the high voltage side.

With the above-mentioned arrangement, the rotating photoreceptor is charged to the predetermined electric potential by the charging means, an electrostatic latent image is formed on the surface of the photoreceptor by the latent image forming means, and this electrostatic latent image is developed by the developing means.

Upon allowing the photoreceptor surface electric potential to rise to the predetermined electric potential during the non-image-forming period in which the photoreceptor is in rotation and no developing operation is carried out by the developing means, the control voltage supply means first supplies a low voltage bias as the control voltage so as to allow the photoreceptor surface to rise to a predetermined low electric potential, and then supplies a control voltage on the high voltage side.

As described above, with the arrangement in which the low voltage bias is supplied as the control voltage so as to allow the photoreceptor surface to rise to a predetermined low electric potential, and then to rise to the predetermined electric potential by supplying the control voltage on the high-voltage side thereto, it is possible to prevent the generation of an unstable portion on the low electric potential side at the time of the rising of the photoreceptor surface electric potential. In other words, it becomes possible to avoid the influence of rounding of the low electric potential portion occurring when the control voltage is supplied by using only a high voltage transformer. Thus, the surface electric potential of the photoreceptor is allowed to rise linearly to the predetermined electrode. As a result, it is possible to prevent degradation in the photoreceptor due to carrier dispersion, degradation in the image quality due to aggregation of toner with scattering carrier serving cores at the time of recycling toner, and adhesion of reversely charged toner to the photoreceptor and an increase of the consumption of toner; consequently, it becomes possible to obtain image having stable image quality.

In the above-mentioned image-forming apparatuses, the control voltage supply means is preferably designed to have a power supply having a Zener diode as the low-voltage bias supply.

With this arrangement, since the control voltage supply means is provided with the Zener diode as the low-voltage bias supply, it is possible to simplify the construction and also to miniaturize the apparatus.

Moreover, the above-mentioned image-forming apparatus is preferably provided with an electric potential eliminating means for eliminating the electric potential of a charged area, prior to the arrival of the charged area on the photoreceptor surface made by the application of the low-voltage bias to the charging means to the developing section between the developing means and the photoreceptor.

In the above-mentioned arrangement, prior to the arrival of the charged area on the photoreceptor surface made by the application of the low-voltage bias to the charging means to the developing section between the developing means and the photoreceptor, the electric potential of the charged area is eliminated.

Thus, even when the photoreceptor surface is charged to a low electric potential by the application of a low-voltage bias to the charging means, it is possible to maintain the fog electric potential uniformly in a stable manner, to prevent the carrier dispersion and PC fog, and consequently to obtain images with stable image quality.

More specifically, when the photoreceptor surface is in a charged state by the application of the low-voltage bias to the charging means, the photoreceptor becomes susceptible in its sensitivity to influences of environments in which the photoreceptor is placed and its service period, and tends to have an irregular surface electric potential. For this reason, the fog electric potential tends to become unstable, resulting in degradation in electric potential stability against the PC fog due to carrier rise and reversely charged toner. Therefore, the application of the above-mentioned arrangement makes it possible to avoid such problems.

Moreover, in the above-mentioned image-forming apparatus, the electric potential eliminating means is preferably made by the latent image forming means.

In the above-mentioned arrangement, the electric potential eliminating means is constituted by utilizing the latent image forming means so that the need for installing a new exclusively-used means as the electric potential eliminating means is eliminated. Consequently, it is possible to simplify the construction, and also to properly deal with the case in which the diameter of the photoreceptor is too small to install a new means on the periphery thereof.

Furthermore, the above-mentioned image-forming apparatus may have another arrangement in which: a developing bias supply means for supplying a developing bias to the developing means is further installed, and the developing bias supply means supplies a developing bias having a reversed polarity to the charging polarity of the photoreceptor surface made by the application of the control voltage to the control electrode for a period before the charged area of the photoreceptor surface made by the application of the control voltage on the high voltage side to the control electrode has reached the developing section, so as to produce an electric potential difference between the surface electric potential of the photoreceptor and the developing bias.

With the above-mentioned arrangement, the developing bias supply means supplies a developing bias having a reversed polarity to the charging polarity of the photoreceptor surface made by the application of the control voltage to the control electrode for a period until the charged area of the photoreceptor surface made by the application of the control voltage on the high voltage side to the control electrode has reached the developing section, so as to produce an electric potential difference between the surface electric potential of the photoreceptor and the developing bias.

Therefore, during the non-image-forming period in which the photoreceptor is in rotation and no developing operation is carried out by the developing means, the electric potential difference between the surface electric potential of the photoreceptor and the developing bias is maintained at a desired value, that is, a desired fog electric potential is maintained. It is possible to prevent adhesion of reversely charged, weakly charged, and zero-charged toner to the photoreceptor during the non-image-forming period, and an increase in the toner consumption; thus, it becomes possible to obtain images with stable image quality.

Moreover, the above-mentioned image-forming apparatus may have an arrangement in which: the developing bias supply means supplies a predetermined developing bias to be used in the developing process, prior to the time when the charged area on the photoreceptor surface made by the application of the control voltage on the high voltage side to the control electrode has reached the developing section.

With the above-mentioned arrangement, the developing bias supply means supplies a predetermined developing bias to be used in the developing process, prior to the time when the charged area on the photoreceptor surface made by the application of the control voltage on the high voltage side to the control electrode has reached the developing section.

Therefore, the fog electric potential is easily maintained virtually at a constant value until the developing bias is allowed to rise to a desired electric potential. In particular, in the case when the predetermined developing bias to be used in the developing process is supplied immediately before the charging area has reached the developing section, it is possible to prevent the fog electric potential from becoming excessive in response to an instantaneous rise of the photoreceptor electric potential following the switchover of the voltage application to the control electrode from the low voltage bias to the high voltage side. As a result, it becomes possible to prevent carrier dispersion due to the excessive fog electric potential and toner adhesion to the photoreceptor surface due to an extremely small fog electric potential, and consequently to obtain image having stable image quality.

Moreover, the above-mentioned image-forming apparatus may have an arrangement in which: the time required for the developing bias to rise to the predetermined electric potential to be used in the developing process from the start of the supply is set within the time required for the control voltage on the high voltage side to rise to a predetermined electric potential from the start of the supply.

With the above-mentioned arrangement, the time required for the developing bias to rise to the predetermined electric potential to be used in the developing process from the start of the supply is set within the time required for the control voltage on the high voltage side to rise to a predetermined electric potential from the start of the supply.

Therefore, at the time of rises of the developing bias and the photoreceptor surface electric potential, the fog electric potential can be maintained within a permissible range without an excessive increase. As a result, it is possible to prevent carrier dispersion and consequently to provide images having stable image quality.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image-forming apparatus comprising:

a rotatable photoreceptor;

charging means for charging the surface of the photoreceptor to a regular electric potential by means of corona discharging, the charging means being provided with a control electrode for controlling a quality of corona ions that are allowed to reach the photoreceptor from a discharging electrode;

latent image forming means for forming an electrostatic latent image on the photoreceptor that has been charged by the charging means by means of light irradiation;

developing means for developing the electrostatic latent image by using a developer; and control voltage supply means for supplying a control voltage to the control electrode, wherein the control voltage supply means switches the control voltage at least once from a low-voltage side to a high-voltage side, during a time period from a time when the control voltage is supplied to the control electrode to a time when the surface electric potential of the photoreceptor has risen to the regular electric potential.

2. The image-forming apparatus as defined in claim 1, wherein the control voltage supply means has a power supply having a Zener diode as a power supply on the low voltage side.

3. The image-forming apparatus as defined in claim 1, wherein the control voltage supply means is constituted by a single transformer having a plurality of output terminals from the low voltage side to the high voltage side.

4. The image-forming apparatus as defined in claim 1, further comprising: developing bias supply means for supplying a developing bias to the developing means, wherein during a non-image forming period in which the photoreceptor is in rotation and no developing operation is carried out by the developing means, the electric potential difference between the surface electric potential of the photoreceptor and the developing bias is maintained in a range of 50 to 400V.

5. The image-forming apparatus as defined in claim 1, further comprising: developing bias supply means for supplying a developing bias to the developing means, wherein during a non-image-forming period in which the photoreceptor is in rotation and no developing operation is carried out by the developing means, the electric potential difference between the surface electric potential of the photoreceptor and the developing bias is maintained in a range of 100 to 200V.

6. The image-forming apparatus as defined in claim 1, further comprising: developing bias supply means for supplying a developing bias to the developing means, wherein the developing bias supply means supplies a developing bias having a reversed polarity to the polarity of the control voltage to the developing means, during a period of time it takes for a portion of the photoreceptor surface having an electric potential rise by an application of a control voltage to the control electrode to reach a developing section between the photoreceptor and the developing means.

7. The image-forming apparatus as defined in claim 1, further comprising: developing bias supply means for supplying a developing bias to the developing means, wherein the developing bias supply means supplies a developing bias having a reversed polarity to the polarity of a charged toner as a developer to the developing means, during a period of time it takes for a portion of the photoreceptor surface having an electric potential rise by an application of a control voltage to the control electrode to reach a developing section between the photoreceptor and the developing means.

8. The image-forming apparatus as defined in claim 1, which carries out a developing operation by means of a reversed developing system.

9. The image-forming apparatus as defined in claim 1, which carries out a developing operation by means of a contact developing system using a two-component developer made of a magnetic carrier and a non-magnetic toner.

10. The image-forming apparatus as defined in claim 1, wherein, when the photoreceptor surface electric potential has a rise by supplying a control voltage to the control electrode, the control voltage supply means switches the control voltage to a next voltage on the high voltage side.

11. The image-forming apparatus as defined in claim 1, wherein during a non-image forming period in which the photoreceptor is in rotation and no developing operation is carried out by the developing means, the control voltage supply means switches the control voltage at least once from the low-voltage side to the high-voltage side, during a time period from a time when the control voltage is supplied to the control electrode to a time when the surface electric potential of the photoreceptor has risen to the regular electric potential.

12. An image-forming apparatus comprising:

a rotatable photoreceptor;

charging means for charging the surface of the photoreceptor to a predetermined electric potential by means of corona discharging, the charging means being provided with a control electrode for controlling the quantity of corona ions that are allowed to reach the photoreceptor from a discharging electrode;

latent image forming means for forming an electrostatic latent image on the photoreceptor that has been charged by the charging means by means of light irradiation;

developing means for developing the electrostatic latent image by using a developer; and control voltage supply means which supplies a control voltage to the control electrode and which, upon allowing the photoreceptor surface electric potential to rise to the predetermined electric potential, during a non-image-forming period in which the photoreceptor is in rotation and no developing operation is carried out by the developing means, first supplies a low voltage bias as the control voltage so as to allow the photoreceptor surface to rise to a predetermined low electric potential, and then supplies a control voltage on the high voltage side.

13. The image-forming apparatus as defined in claim 12, wherein the control voltage supply means has a power supply having a Zener diode as a power supply for supplying the low voltage bias.

14. The image-forming apparatus as defined in claim 12, further comprising:

an electric potential eliminating means for eliminating the electric potential of a charged area, prior to an arrival of the charged area on the photoreceptor surface made by the application of the low-voltage bias to the charging means to a developing section between the developing means and the photoreceptor.

15. The image-forming apparatus as defined in claim 14, wherein the electric potential eliminating means is constituted by the latent image forming means.

16. The image-forming apparatus as defined in claim 14, wherein the electric potential eliminating means is placed between the charging means and the developing means, and provided with a contact member for eliminating the electric potential on the photoreceptor surface by contacting the photoreceptor surface.

17. The image-forming apparatus as defined in claim 16, wherein the electric potential eliminating means is further provided with an electric potential eliminating power supply for supplying a voltage for eliminating the electric potential on the photoreceptor surface.

18. The image-forming apparatus as defined in claim 16, wherein the electric potential eliminating means is further provided with ground/non-ground switching means which switches the contact member between a grounded state and a non-grounded state.

19. The image-forming apparatus as defined in claim 14, wherein the electric potential eliminating means is provided with a discharging means for eliminating the electric potential on the photoreceptor surface by means of corona discharging.

20. The image-forming apparatus as defined in claim 14, wherein the electric potential eliminating means is provided with an static eliminating light source for eliminating the electric potential on the photoreceptor surface by means of light irradiation to the photoreceptor.

21. The image-forming apparatus as defined in claim 14, further comprising: developing bias supplying means for supplying a developing bias to the developing means, wherein the developing bias supply means supplies a developing bias having a reversed polarity to the charging polarity of the photoreceptor surface made by the application of the control voltage to the control electrode for a period before the charged area of the photoreceptor surface made by the application of the control voltage on the high voltage side to the control electrode has reached the developing section, so as to produce an electric potential difference between the surface electric potential of the photoreceptor and the developing bias.

22. The image-forming apparatus as defined in claim 21, wherein the developing bias supply means supplies a predetermined developing bias used at the time of developing, prior to the arrival of the charged area on the photoreceptor surface made by the application of the control voltage on the high voltage side to the control electrode to the developing section.

23. The image-forming apparatus as defined in claim 14, wherein a period of time required for the developing bias to rise to a predetermined electric potential to be used in a developing process from the start of the supply is set within a period of time required for the control voltage on the high voltage side to rise to a predetermined electric potential from the start of the supply.

24. The image-forming apparatus as defined in claim 12, further comprising: developing bias supply means for supplying a developing bias to the developing means, wherein during the non-image-forming period in which the photoreceptor is in rotation and no developing operation is carried out by the developing means, the electric potential difference between the surface electric potential of the photoreceptor and the developing bias is maintained in a range of 50 to 400V.

25. The image-forming apparatus as defined in claim 12, further comprising: developing bias supply means for supplying a developing bias to the developing means, wherein during the non-image-forming period in which the photoreceptor is in rotation and no developing operation is carried out by the developing means, the electric potential difference between the surface electric potential of the photoreceptor and the developing bias is maintained in a range of 100 to 200V.

26. The image-forming apparatus as defined in claim 12, which carries out a developing operation by means of a reversed developing system.

27. The image-forming apparatus as defined in claim 12, which carries out a developing operation by means of a contact developing system using a two-component developer made of a magnetic carrier and a non-magnetic toner.

* * * * *